US012714920B2

(12) United States Patent
Schier et al.

(10) Patent No.: US 12,714,920 B2
(45) Date of Patent: Aug. 25, 2026

(54) GOLF CLUB HEAD WITH DESCENDING FACE THICKNESS

(71) Applicant: KARSTEN MANUFACTURING CORPORATION, Phoenix, AZ (US)

(72) Inventors: Matthew T. Schier, Phoenix, AZ (US); Eric J. Morales, Laveen, AZ (US); Lance R. White, Phoenix, AZ (US); Cory S. Bacon, Scottsdale, AZ (US); Nathan S. Hawley, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 140 days.

(21) Appl. No.: 18/393,507

(22) Filed: Dec. 21, 2023

(65) Prior Publication Data

US 2024/0207696 A1 Jun. 27, 2024

Related U.S. Application Data

(60) Provisional application No. 63/476,627, filed on Dec. 21, 2022.

(51) Int. Cl.
*A63B 53/04* (2015.01)

(52) U.S. Cl.
CPC ..... *A63B 53/0462* (2020.08); *A63B 53/0416* (2020.08); *A63B 53/0454* (2020.08); *A63B 53/0458* (2020.08)

(58) Field of Classification Search
CPC ..... A63B 53/00; A63B 53/04; A63B 53/0462; A63B 53/0416; A63B 53/0454; A63B 53/0408; A63B 53/0458; A63B 60/00; A63B 2209/00
USPC ..... 473/324, 329, 332
See application file for complete search history.

(56) References Cited

U.S. PATENT DOCUMENTS

| | | | | |
|---|---|---|---|---|
| 5,356,138 | A * | 10/1994 | Chen | A63B 53/047 473/291 |
| 5,362,047 | A * | 11/1994 | Shaw | A63B 53/04 473/345 |
| 7,874,936 | B2 | 1/2011 | Chao | |
| 8,012,041 | B2 | 9/2011 | Gibbs | |
| 8,088,025 | B2 | 1/2012 | Wahl | |
| 8,480,514 | B2 | 7/2013 | Hartwell | |
| 8,911,302 | B1 | 12/2014 | Ivanova | |
| 9,138,622 | B1 * | 9/2015 | DeMille | A63B 60/00 |
| 9,457,241 | B2 | 10/2016 | Hebreo | |

(Continued)

FOREIGN PATENT DOCUMENTS

| | | |
|---|---|---|
| JP | 4719113 | 7/2011 |
| JP | 4783579 | 9/2011 |

(Continued)

OTHER PUBLICATIONS

International Search Report/Written Opinion for Intl Patent Application No. PCT/US2023/085564, published on Mar. 13, 2024.

(Continued)

*Primary Examiner* — John E Simms, Jr.

(57) ABSTRACT

A golf club head comprising a variable face thickness wherein the face thickness is greater in an upper faceplate portion than a lower faceplate portion. The variable face thickness provides an increased flexibility in the lower faceplate portion to increase ball speed on lower struck shots relative to a uniform thickness faceplate.

11 Claims, 18 Drawing Sheets

(56) References Cited

U.S. PATENT DOCUMENTS

| | | | | |
|---|---|---|---|---|
| 9,539,478 | B2 | 1/2017 | Narita | |
| 10,065,083 | B2 * | 9/2018 | Beach | A63B 60/00 |
| 10,207,163 | B2 | 2/2019 | Mizutani | |
| 11,318,358 | B1 | 5/2022 | Story | |
| 11,351,426 | B2 | 6/2022 | Demkowski | |
| 11,565,158 | B1 * | 1/2023 | Parsons | A63B 60/02 |
| 11,617,927 | B2 | 4/2023 | Nielson | |
| 11,951,364 | B2 | 4/2024 | Shimahara | |
| 2003/0153397 | A1 * | 8/2003 | Roach | A63B 60/00 473/290 |
| 2009/0239680 | A1 * | 9/2009 | Horacek | A63B 53/0466 473/349 |
| 2011/0312437 | A1 * | 12/2011 | Sargent | A63B 53/06 473/335 |
| 2012/0196702 | A1 * | 8/2012 | Shimazaki | A63B 53/047 473/345 |
| 2015/0024869 | A1 * | 1/2015 | Kitagawa | A63B 53/047 473/331 |
| 2015/0352412 | A1 * | 12/2015 | Narita | A63B 53/047 473/333 |
| 2017/0246517 | A1 * | 8/2017 | Ueda | A63B 53/047 |
| 2017/0326415 | A1 * | 11/2017 | Henrikson | A63B 60/52 |
| 2018/0154226 | A1 * | 6/2018 | Milleman | A63B 53/06 |
| 2019/0091524 | A1 * | 3/2019 | Slaughter | A63B 60/00 |
| 2019/0201754 | A1 * | 7/2019 | Hoffman | A63B 60/02 |
| 2019/0217162 | A1 * | 7/2019 | Seagram | A63B 53/02 |
| 2021/0046361 | A1 * | 2/2021 | Morales | A63B 53/0412 |
| 2022/0001250 | A1 | 1/2022 | Slaughter | |
| 2023/0347213 | A1 | 11/2023 | Carr | |
| 2023/0364478 | A1 | 11/2023 | Munson | |

FOREIGN PATENT DOCUMENTS

| | | |
|---|---|---|
| JP | 5416737 | 2/2014 |
| JP | 6273670 | 2/2018 |

OTHER PUBLICATIONS

International Preliminary Report on Patentability for Intl Patent Application No. PCT/US2023/085564, published on Dec. 13, 2024.

* cited by examiner

GOLF CLUB HEAD WITH DESCENDING FACE THICKNESS

CROSS REFERENCE TO RELATED APPLICATIONS

This claims the benefit of U.S. Provisional Application No. 63/476,627, filed Dec. 21, 2022, which is fully incorporated herein by reference.

TECHNICAL FIELD

This disclosure relates generally to golf club heads and, more particularly, relates to golf club heads comprising variable thickness faceplates.

BACKGROUND

Golf club designs must balance different performance characteristics, such as ball speed, forgiveness, launch angle, and spin. The average golfer contacts a golf ball off-center from the intended strike location (e.g., away from the center of the strike face). Therefore, golf club heads aim to increase ball speed on off-center hits through a variable face thickness profile. Irons are typically mishit in the lower region of the strike face because a majority of iron shots are hit off turf. As such, there is a need in the art for a golf club head that is designed to increase ball speed on low mishits (i.e., below the center of the strike face).

BRIEF DESCRIPTION OF THE DRAWINGS

To facilitate further description of the embodiments, the following drawings are provided in which.

Figure 1:
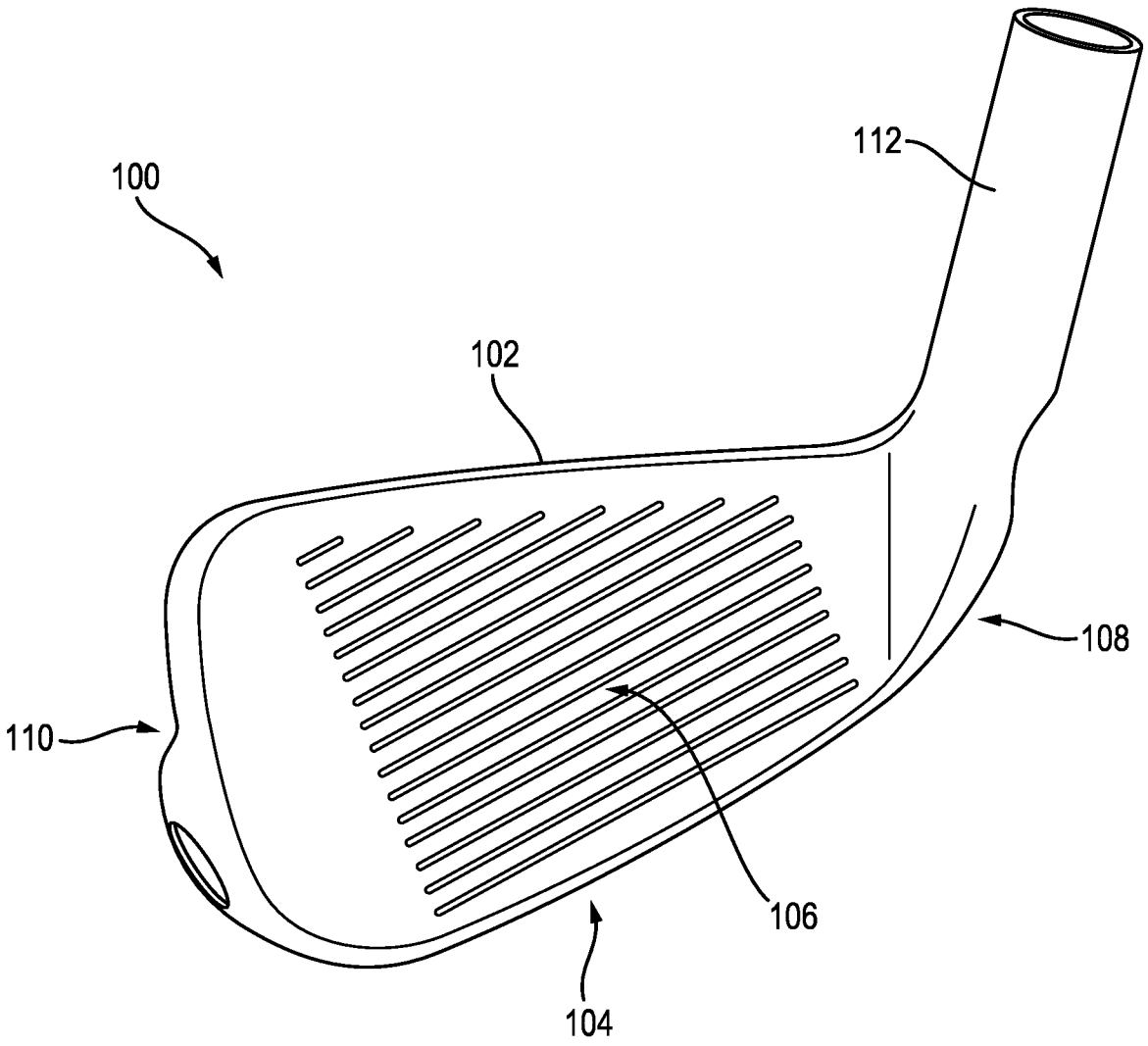
FIG. 1 illustrates a front-perspective view of a golf club head.

For simplicity and clarity of illustration, the drawing figures illustrate the general manner of construction, and descriptions and details of well-known features and techniques may be omitted to avoid unnecessarily obscuring the invention. Additionally, elements in the drawing figures are not necessarily drawn to scale. For example, the dimensions of some of the elements in the figures may be exaggerated relative to other elements to help improve understanding of embodiments of the present invention. The same reference numerals in different figures denotes the same elements.

Definitions

The terms "first," "second," "third," "fourth," and the like as used herein, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements but may include other elements not expressly listed or inherent to such process, method, system, article, device, or apparatus.

The terms "left," "right," "front," "back," "top," "bottom," "over," "under," and the like as used herein, are used for descriptive purposes and not necessarily for describing permanent relative positions. It is to be understood that the terms so used are interchangeable under appropriate circumstances such that the embodiments of the invention described herein are, for example, capable of operation in other orientations than those illustrated or otherwise described herein.

The terms "couple," "coupled," "couples," "coupling," and the like, as used herein, broadly refer to connecting two or more elements or signals, electrically, mechanically and/or otherwise.

The term "strike face," as used herein, refers to a club head front surface that is configured to strike a golf ball. The term strike face can be used interchangeably with the "face."

The term "strike face perimeter," as used herein, can refer to an edge of the strike face. The strike face perimeter can be located along an outer edge of the strike face where the curvature deviates from a bulge and/or roll of the strike face.

The term "strike face thickness," "face thickness," or "faceplate thickness" as used herein, can be defined as the distance between a strike face front surface and a strike face rear surface or a faceplate front surface and a faceplate rear surface. In the embodiments comprising a faceplate, the term "face thickness" or "faceplate thickness," as used herein, can be defined as the distance between a faceplate front surface and a faceplate rear surface.

The term "geometric centerpoint," or "geometric center" of the strike face, as used herein, can refer to a geometric centerpoint of the strike face perimeter, and at a midpoint of the face height of the strike face. In the same or other examples, the geometric centerpoint also can be centered with respect to an engineered impact zone, which can be defined by a region of grooves on the strike face. As another approach, the geometric centerpoint of the strike face can be located in accordance with the definition of a golf governing body such as the United States Golf Association (USGA).

The term "ground plane," as used herein, can refer to a reference plane associated with the surface on which a golf ball is placed. A ground plane 1070 can be a horizontal plane tangent to the sole at an address position.

The term "loft plane," as used herein, can refer to a reference plane (i.e., a loft plane 1080) that is tangent to the geometric centerpoint of the strike face.

The term "loft angle," as used herein, can refer to an angle measured between the loft plane and the XY plane (defined below).

The term "face height," as used herein, can refer to a distance measured parallel to the loft plane 1080 between a top end of the strikeface perimeter and a bottom end of the strikeface perimeter. The face height can be measured at the geometric center.

The "height" of the golf club head, as used herein, can be defined as a top rail-to sole dimension of the golf club head. In many embodiments, the height of the club head can be measured acm$^3$ording to a golf governing body such as the United States Golf Association (USGA).

The "length" of the golf club head, as used herein, can be defined as a heel-to-toe dimension of the golf club head. In many embodiments, the length of the club head can be measured acm$^3$ording to a golf governing body such as the United States Golf Association (USGA).

The "face height" of the golf club head, as used herein, can be defined as a height measured perpendicular to the ground plane 1070 and parallel to loft plane between a top end of the strike face perimeter near the top rail and a bottom end of the strike face perimeter near the sole.

The "geometric center height" of the fairway-type golf club head, as used herein, is a height measured perpendicular from the ground plane 1070 to the geometric centerpoint of the golf club head.

The "leading edge" of the club head, as used herein, can be identified as the most sole-ward portion of the strike face perimeter.

Figure 2:
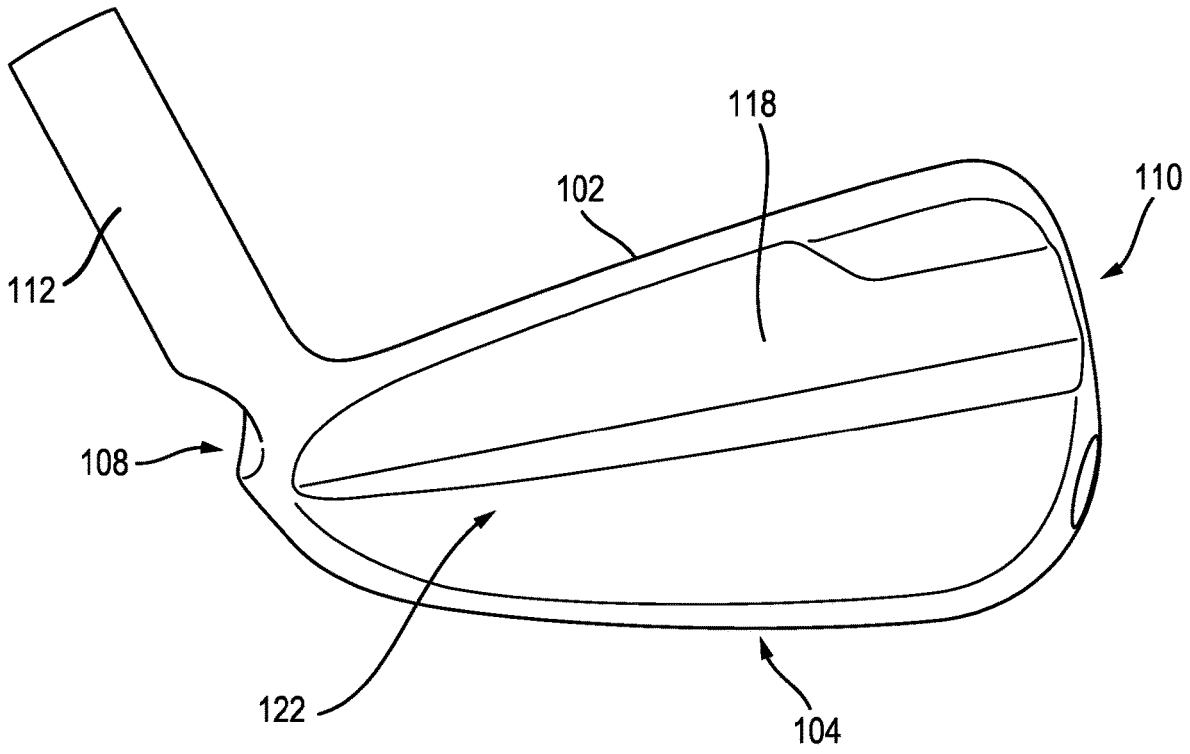
FIG. 2 illustrates a rear view of the golf club head of FIG. 1.
Figure 3:
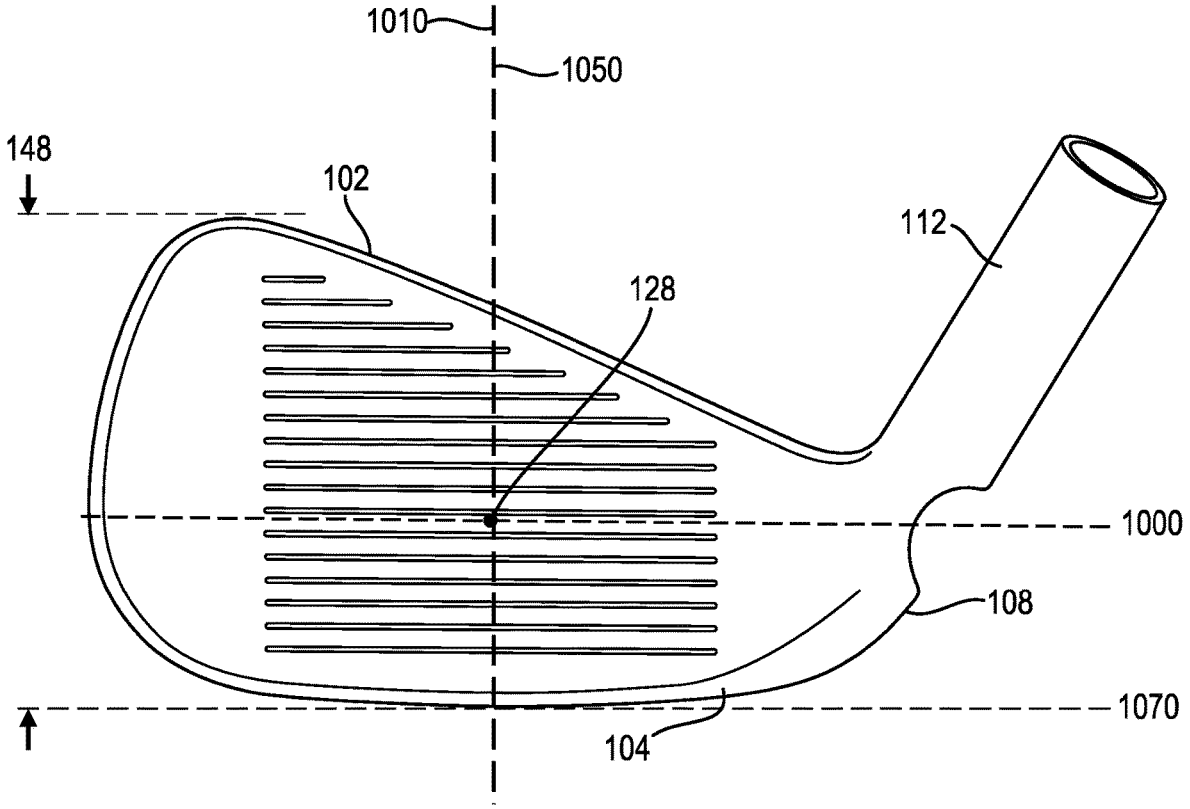
FIG. 3 illustrates a front view of the golf club head of FIG. 1.
Figure 4:
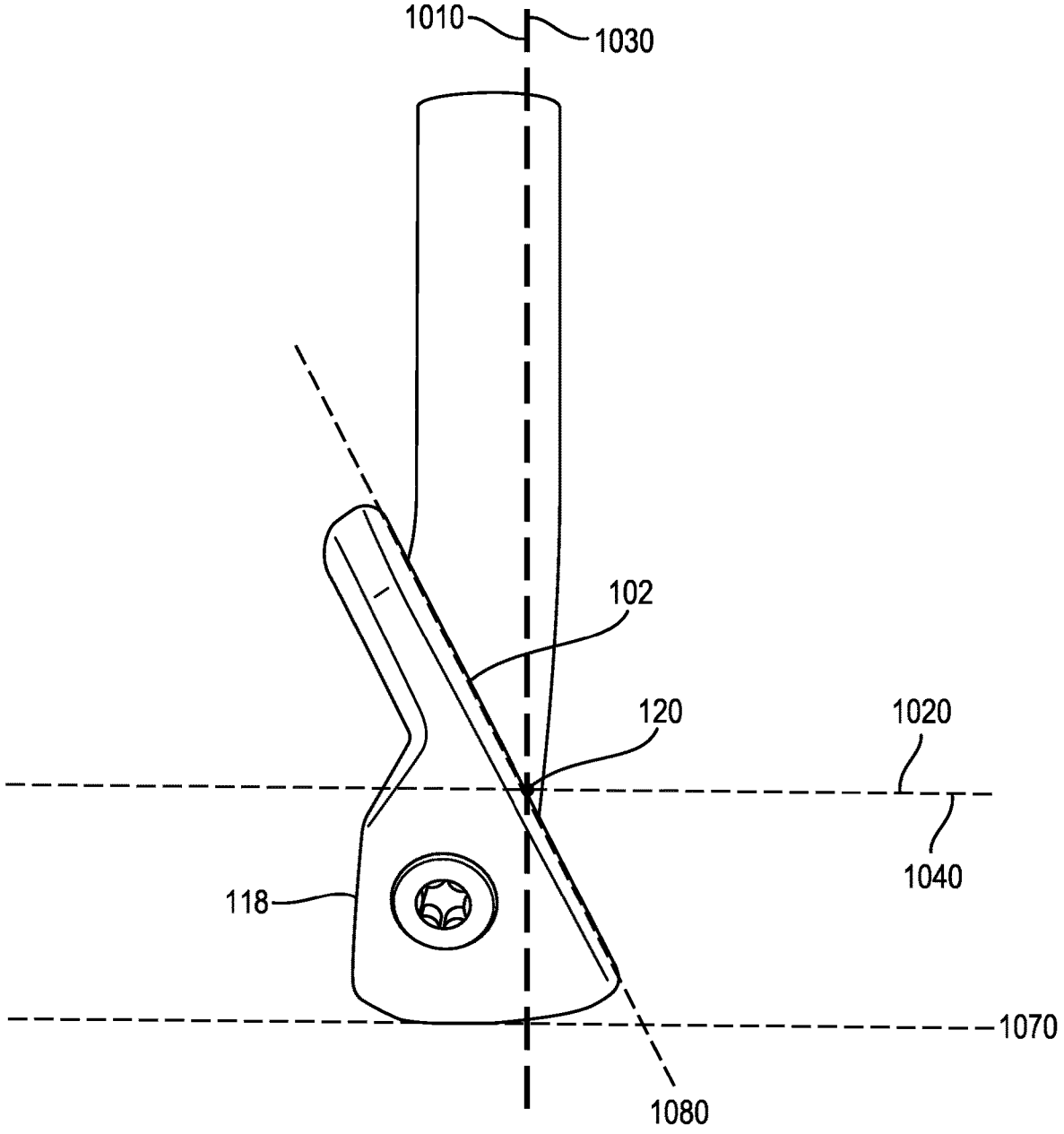
FIG. 4 illustrates a toe side view of the golf club head of FIG. 1.
Figure 5A:
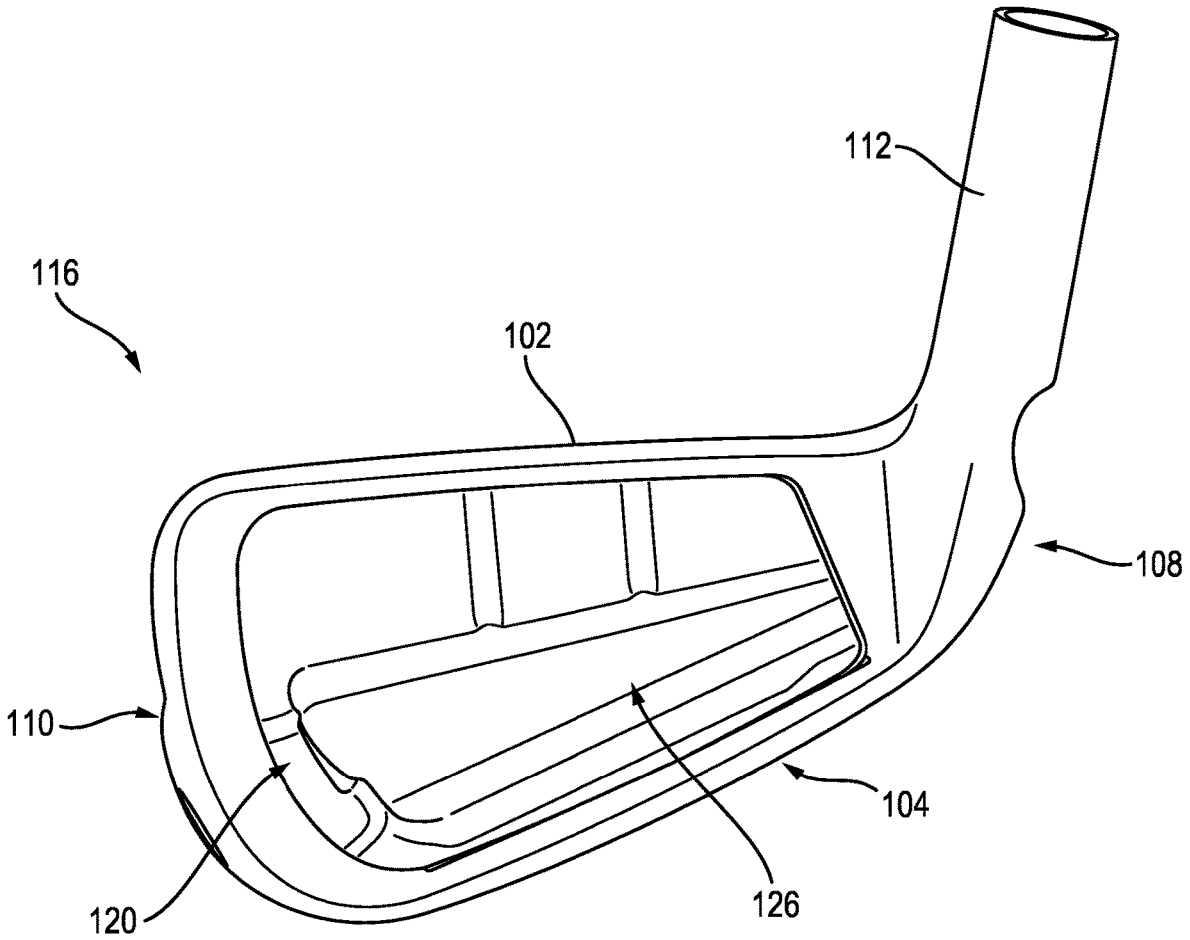
FIG. 5*a* illustrates a front-perspective view of a rear body of the golf club head of FIG. 1.
Figure 5B:
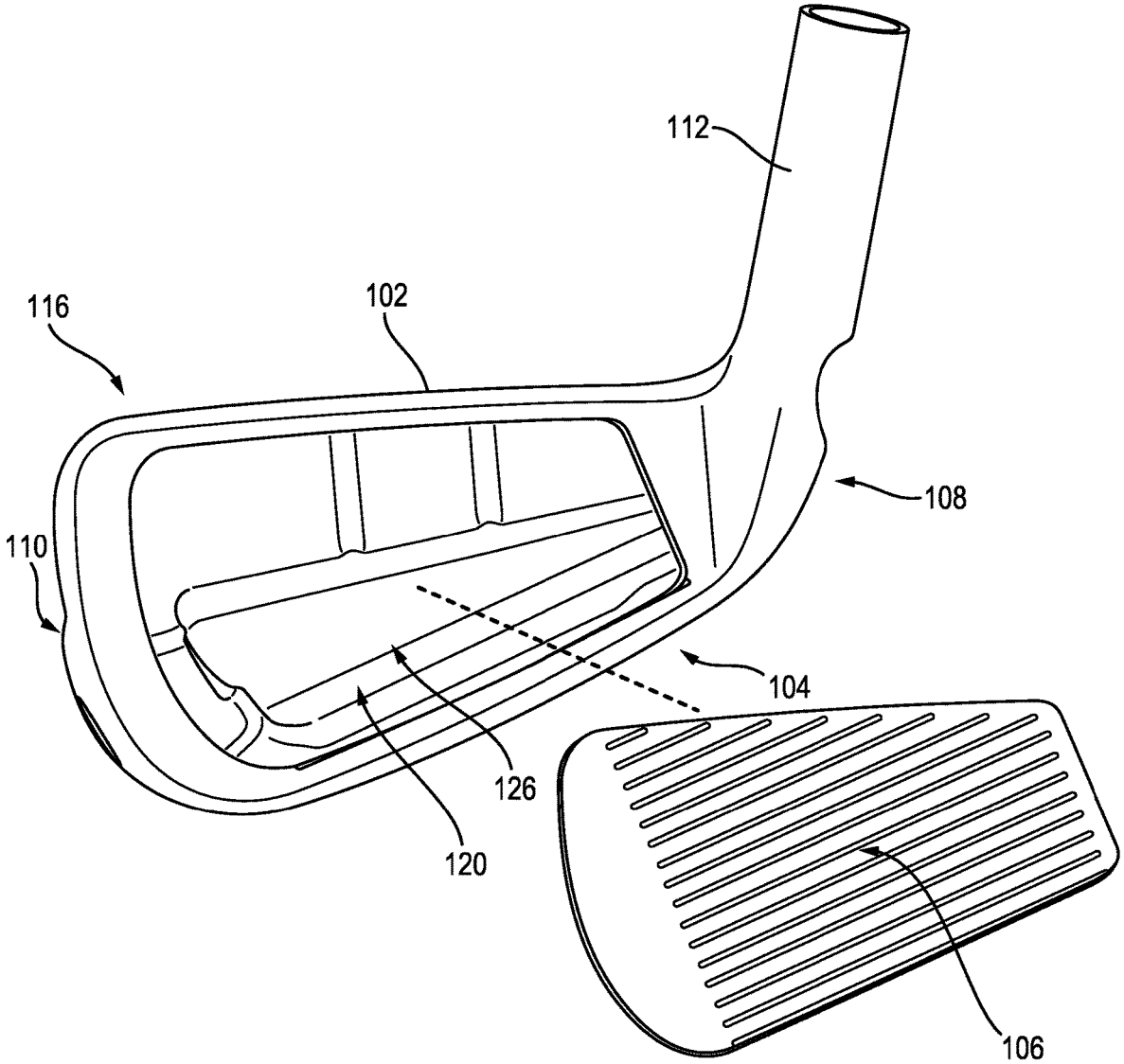
FIG. 5*b* illustrates a front-perspective exploded view of the golf club head of FIG. 1 comprising a rear body and a face plate.

An "XYZ" coordinate system of the golf club head, as used herein, is based upon the geometric center of the strike face. The golf club head dimensions as described herein can be measured based on a coordinate system as defined below. Referring to FIGS. 3 and 4, the geometric center of the strike face defines a coordinate system having an origin located at the geometric center of the strike face. As shown in FIGS. 2-3, the coordinate system defines an X axis 1000, a Y axis 1010, and a Z axis 1020. The X axis 1000 extends through the geometric center of the strike face in a direction from the heel to the toe of the fairway-type club head. The Y axis 1010 extends through the geometric center of the strike face in a direction from the top rail to the sole of golf club head. The Y axis is perpendicular to the X axis. The Z axis 1020 extends through the geometric center of the strike face in a direction from a front end to a rear end of the golf club head. The Z axis is perpendicular to both the X axis and the Y axis.

The XYZ coordinate system of the golf club head, as used herein defines a XY plane 1030 extending through the X axis 1000 and the Y axis 1010. The coordinate system defines a XZ plane 1040 extending through the X axis 1000 and the Z axis 1020. The coordinate system further defines a YZ plane 1050 extending through the Y axis 1010 and the Z axis 1020. The XY plane 1030, the XZ plane 1040, and the YZ plane 1050 are all perpendicular to one another and intersect at the coordinate system origin located at the geometric center of the strike face. In these or other embodiments, the golf club head can be viewed from a front view when the strike face is viewed from a direction perpendicular to the XY plane 1030. Further, in these or other embodiments, the golf club head can be viewed from a side view or side cross-sectional view when the heel is viewed from a direction perpendicular to the YZ plane 1050.

The term "iron," as used herein, can, in some embodiments, refer to an cavity back, hollow, blade, or cap back iron-type golf club head having a loft angle that is less than approximately 50 degrees, less than approximately 49 degrees, less than approximately 48 degrees, less than approximately 47 degrees, less than approximately 46 degrees, less than approximately 45 degrees, less than approximately 44 degrees, less than approximately 43 degrees, less than approximately 42 degrees, less than approximately 41 degrees, or less than approximately 40 degrees. Further, in many embodiments, the loft angle of the club head is greater than approximately 16 degrees, greater than approximately 17 degrees, greater than approximately 18 degrees, greater than approximately 19 degrees, greater than approximately 20 degrees, greater than approximately 21 degrees, greater than approximately 22 degrees, greater than approximately 23 degrees, greater than approximately 24 degrees, or greater than approximately 25 degrees.

In many embodiments, the volume of the iron-type golf club head is less than approximately 65 cm$^3$, less than approximately 60 cm$^3$, less than approximately 55 cm$^3$, or less than approximately 50 cm$^3$. In some embodiments, the volume of the club head can be approximately 50 cm$^3$ to 60 cm$^3$, approximately 51 cm$^3$-53 cm$^3$, approximately 53 cm$^3$-55 cm$^3$, approximately 55 cm$^3$-57 cm$^3$, or approximately 57 cm$^3$-59 cm$^3$. In other embodiments, the volume of the club head is less than approximately 45 cm$^3$, less than approximately 40 cm$^3$, less than approximately 35 cm$^3$, or less than approximately 30 cm$^3$. In some embodiments, the volume of the club head can be approximately 31 cm$^3$-38 cm$^3$ (1.9 cubic inches to 2.3 cubic inches), approximately 31 cm$^3$-33 cm$^3$, approximately 33 cm$^3$-35 cm$^3$, approximately 35 cm$^3$-37 cm$^3$, or approximately 37 cm$^3$-39 cm$^3$.

In some embodiments, the iron type club head can comprise a total mass ranging between 180 grams and 260 grams, 190 grams and 240 grams, 200 grams and 230 grams, 210 grams and 220 grams, or 215 grams and 220 grams. In some embodiments, the total mass of the club head is 215 grams, 216 grams, 217 grams, 218 grams, 219 grams, or 220 grams.

DESCRIPTION

Described herein are embodiments of an iron-type golf club head comprising a faceplate having an upper portion thickness that is greater than a lower portion thickness. Reduced thickness in the lower portion increases flexibility near the bottom of the faceplate. On low mis-hit impactions, the lower portion produces ball speeds that are more consistent with center strikes. In some embodiments, the faceplate thickness gradually tapers from the top rail to the sole. In other embodiments, an entirety of the lower portion has a lower portion thickness that is less than the upper portion thickness.

Referring to FIGS. 1-5, a club head 100 can comprise a hollow-body construction. The club head 100 can comprise a faceplate 114 coupled to a rear body 116, which combine to enclose a hollow interior cavity 126. The rear body 116 forms a top rail 102 portion, a sole 104, a heel 108, a toe 110, a hosel 112, and a rear wall 118. The faceplate 114 forms at least a majority of a strike face 106 of the club head 100. For example, the strike face 106 can be formed by the faceplate 114 as well as portions of the rear body 116 surrounding the faceplate 114. A rear wall 118 extends upward from the sole 104 to the top rail 102 and encloses the rear end 122 of the club head 100. The rear body 116 further comprises an opening 120 proximate a front end of the club head 100, the opening 120 being formed between the top rail 102, the heel 108, the toe 110, and the sole 104 of the rear body 116. The opening 120 is configured to receive the faceplate 114. The faceplate 114 is coupled to the rear body 116 to cover the opening 120 and enclose the hollow interior cavity 126. In some embodiments, the faceplate 114 can be inserted into the opening 120 such that a portion of the strike face 106 is formed by the forwardmost portions of the rear body 116. The club head can be a cavity-back iron, wherein the rear wall does not cover the entire rear end of the club head and therefore provides an exposed rear cavity rather than a hollow interior cavity. Additionally, the club head can be a capped-back iron, wherein the club head body comprises a cavity in the rear that is enclosed with a cap to create a hollow interior cavity.

The faceplate 114 can comprise a faceplate front surface 144 and a faceplate rear surface 146. The faceplate front surface 144 and the faceplate rear surface 146 can be used to measure a faceplate 114 thickness as defined above.

As discussed above, the faceplate 114 comprises multiple thicknesses. In many embodiments, the overall thickness of the faceplate 114 decreases from the top of the faceplate 114 (i.e., near the top rail 102) to the bottom of the faceplate 114 (i.e., near the sole 104). In one embodiment, referring to FIG. 6, the strike face 106 can comprises a horizontal midline 1060 extending in a heel-to-toe direction and parallel to the ground plane at an address position. The horizontal midline 1060 can divide the faceplate 114 into a faceplate upper portion 132 and a faceplate lower portion 140. The upper portion 132 can comprise a thickness greater than the lower portion 140 to enable an increase in ball speed on golf ball impacts that occur lower than the horizontal midline 1060. In some embodiments, the horizontal midline 1060 can be located approximately halfway between an uppermost point of the strike face 106 and a lowermost point of the strike face 106, which are both taken relative the geometric center 128 along the YZ plane 1050. The horizontal midline 1060 can be located approximately a third of the way between the uppermost point of the strike face 106 and the lowermost point of the strike face 106. The horizontal midline 1060 can be located approximately two thirds of the way between the uppermost point of the strike face 106 and the lowermost point of the strike face 106. The horizontal midline 1060 can be located approximately three quarters of the way between the uppermost point of the strike face 106 and the lowermost point of the strike face 106. The horizontal midline 1060 location on the face dictates how much of the face is made up of the lower portion 140 and the upper portion 132, and the location of the transition between the lower portion 140 and the upper portion 132. Changing the position and size of the upper portion 132, and the lower portion 140 creates different bending characteristics within the faceplate 114. In other embodiments, the horizontal midline 1060 can intersect the geometric center 128 of the strike face 106. The horizontal midline 1060 can also be offset a distance from the bottommost potin of the strike face.

The horizontal midline 1060 can comprise a horizontal midline height 150 defined as the distance from the bottommost point of the strike face 106 to the horizontal midline 1060 in a direction parallel to the Y axis 1010 and perpendicular the ground plane 1070. The horizontal midline height 150, can be between approximately 0.50 inches and 1.80 inches. The horizontal midline height 150 can be between 0.50 inches and 0.60 inches, 0.60 inches and 0.70 inches, 0.70 inches and 0.80 inches, 0.80 inches and 0.90 inches, 0.90 inches and 1.00 inches, 1.00 inches and 1.10 inches 1.10 inches and 1.20 inches, 1.20 inches and 1.30 inches, 1.30 inches and 1.40 inches, 1.60 inches and 1.50 inches 1.50 inches and 1.60 inches, 1.60 inches and 1.70 inches, or 1.70 inches and 1.80 inches. The horizontal midline height 150, can be less than 1.80 inches, less than 1.70 inches, less than 1.60 inches, less than 1.50 inches, less than 1.40 inches, less than 1.30 inches, less than 1.20 inches, less than 1.10 inches, less than 1.00 inches, less than 0.90 inches, less than 0.80 inches, less than 0.70 inches, less than 0.60 inches, or less than 0.50 inches. The position of the horizontal midline dictates the location of the transition between the upper portion 132 and the lower portion 140 on the faceplate 114. The horizontal midline height 150 can also be measured from the ground plane 1070 and be defined as the distance between the ground plane 1070 and the horizontal midline 1060 measured in the Y axis 1010.

In some embodiments, the horizontal midline 1060 can be located at a predetermined height relative to the strike face height 148. In some embodiments, the horizontal midline height 150 can be between approximately 30% and 80% of the strike face height 148. In other embodiments, the height at which the horizontal midline 1060 is located can be between approximately 30% and 35%, 35% and 40%, 40% and 45%, 45% and 50%, 50% and 55%, 55% and 60%, 60% and 65%, 65% and 70%, 70% and 75%, or 75% and 80% of the strike face height 148. In other embodiments, the height at which the horizontal midline 1060 is located is less than 80%, less than 75%, less than 70%, less than 65%, less than 60%, less than 55%, less than 50%, less than 45%, less than 40%, less than 35%, or less than 30%, of the strike face height. In some embodiments the horizontal midline 1060 can be located at 40%, 41%, 42%, 43%, 44%, 45%, 46%, 47%, 48%, 49%, 50%, 51%, 52%, 53%, 54%, 55%, 56%, 57%, 58%, 59%, or 60% of the strike face height. The position of the horizontal midline dictates the location of the transition between the upper portion 132 and the lower portion 140 on the faceplate 114.

Figure 6:
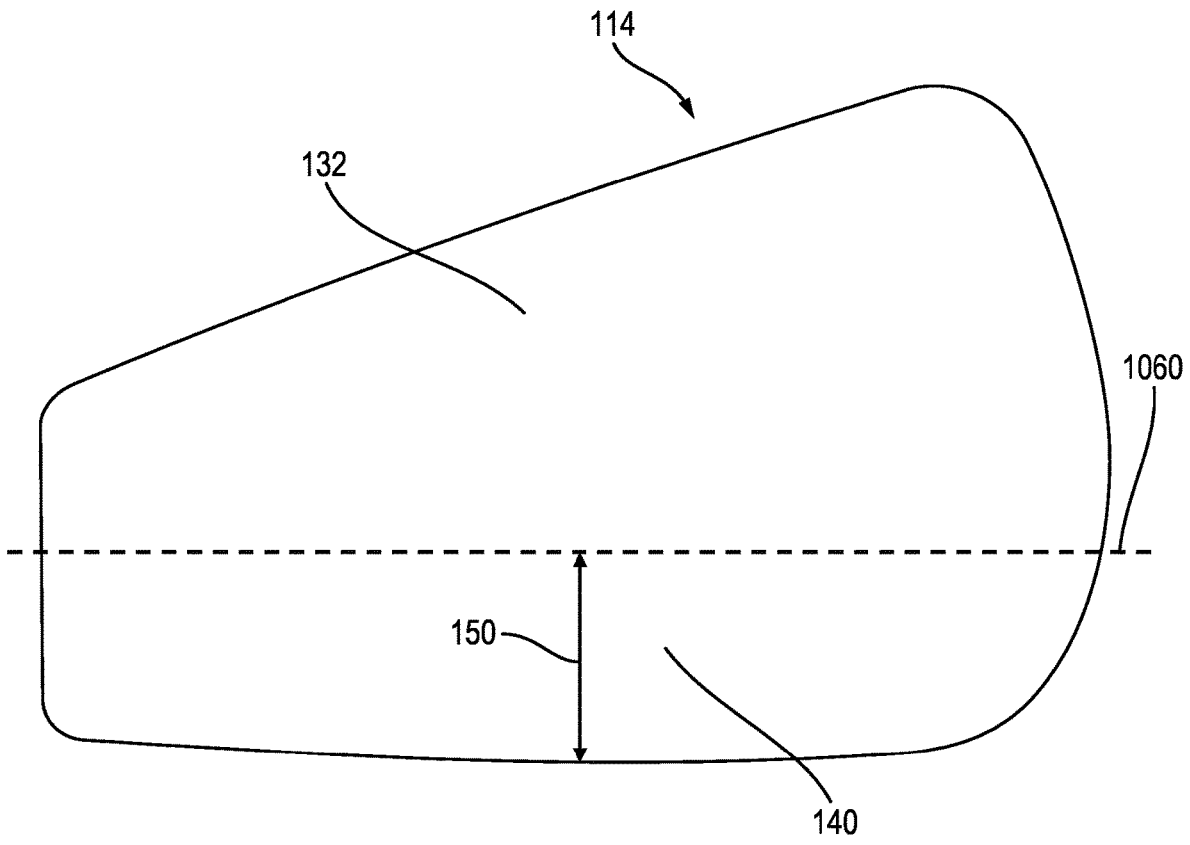
FIG. 6 illustrates a rear view of the faceplate of the golf club head of FIG. 1, according to a first embodiment.

Described in more detail below, the faceplate can comprise an upper portion 132, located above the horizontal midline 1060, and a lower portion 140, located below the horizontal midline 1060, which can be seen in FIG. 6. The relationships between the upper portion and the lower portion dictate are beneficial for increasing ball speed, manipulation of ball flight, and manipulation of launch characteristics. These relationships include the thickness relationship of both the upper and lower portions 132, 140, the size of the upper and lower portions 132, 140, the shaping of the upper and lower portions, the location of the horizontal midline 1060 which dictates the transition between the upper portion and lower portion, as well as other portions described below. These relationships are beneficial in increasing ball speed on off-center hits while retaining the facial support and durability required of a golf club.

Figure 7:
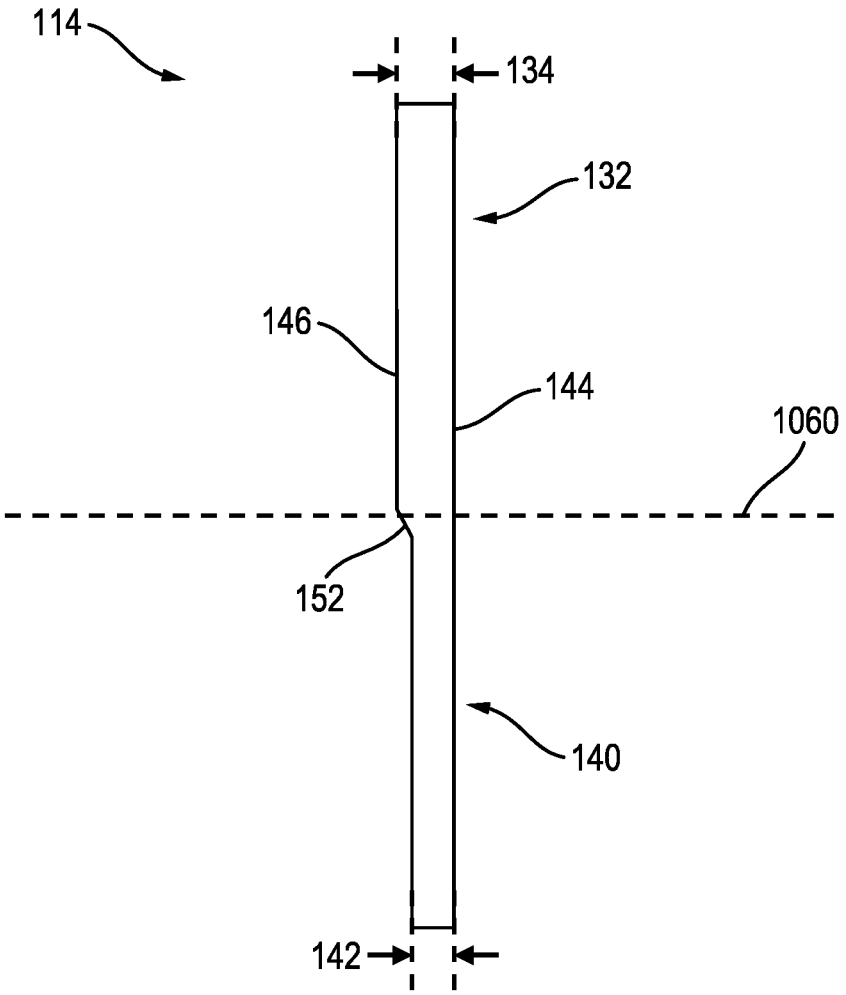
FIG. 7 illustrates a side view of the faceplate of the golf club head of FIG. 1, according to the first embodiment.

Referring to FIG. 7, the faceplate upper portion 132 can comprise a faceplate upper portion thickness 134 and the faceplate lower portion 140 can comprise a faceplate lower portion thickness 142. The faceplate upper portion thickness 134 can be greater than the faceplate lower portion thickness 142. In the embodiment of FIG. 7, the faceplate upper portion thickness 134 and the faceplate lower portion thickness 142 can each be substantially constant. In other embodiments, the faceplate upper portion thickness 134 and the faceplate lower portion thickness 142 can each be variable, but yet different from each other. In other embodiments, the faceplate upper portion thickness 134 can be substantially constant and the faceplate lower portion thickness 142 can each be variable. In other embodiments, the faceplate upper portion thickness 134 can be variable and the faceplate lower portion thickness 142 can each be substantially constant.

The faceplate 114 can comprise a maximum thickness. In general, the faceplate upper portion 132 comprises the maximum thickness of the faceplate 114. In many embodiments, the maximum thickness can be between approximately 0.080 inch and 0.120 inch. The faceplate 114 maximum thickness can be between 0.080 inch and 0.085 inch, 0.085 inch and 0.090 inch, 0.090 inch and 0.095 inch, 0.095 inch and 0.100 inch, 0.100 inch and 0.105 inch, 0.105 inch and 0.110 inch, 0.0110 inch and 0.115 inch, or 0.115 inch and 0.120 inch.

As discussed above, the faceplate upper portion 132 can comprise a variable thickness. The faceplate upper portion 132 can comprise a maximum upper portion thickness and a minimum upper portion thickness. In many embodiments, the maximum upper portion thickness can be between approximately 0.080 inch and 0.120 inch. The maximum upper portion thickness can be between 0.080 inch and 0.085 inch, 0.085 inch and 0.090 inch, 0.090 inch and 0.095 inch, 0.095 inch and 0.100 inch, 0.100 inch and 0.105 inch, 0.105 inch and 0.110 inch, 0.0110 inch and 0.115 inch, or 0.115 inch and 0.120 inch. In many embodiments, the minimum upper portion thickness 134 can be between approximately 0.070 inch and 0.090 inch. The minimum upper portion thickness can be between 0.070 inch and 0.075 inch, 0.075 inch and 0.080 inch, 0.080 inch and 0.085 inch, or 0.085 inch and 0.090 inch.

In embodiments where the faceplate upper portion 132 comprises a constant thickness, the faceplate upper portion thickness can be between 0.07 inch and 0.12 inch. The upper portion 132 thickness can be between 0.070 inch and 0.075 inch, 0.075 inch and 0.080 inch, 0.080 inch and 0.085 inch, 0.085 inch and 0.090 inch, 0.090 inch and 0.095 inch, 0.095 inch and 0.100 inch, 0.100 inch and 0.105 inch, 0.105 inch and 0.110 inch, 0.0110 inch and 0.115 inch, or 0.115 inch and 0.120 inch. The upper portion thickness can be greater than 0.070 inch, 0.075 inch, 0.080 inch, 0.085 inch, 0.090 inch, 0.095 inch, 0.100 inch, 0.105 inch, 0.110 inch, 0.115 inch, or 0.120 inch. In other embodiments, the faceplate upper portion 132 thickness can be 0.070 inch, 0.071 inch, 0.072 inch, 0.073 inch, 0.074 inch, 0.075 inch, 0.076 inch, 0.077 inch, 0.078 inch, 0.079 inch, 0.080 inch, 0.081 inch, 0.082 inch, 0.083 inch, 0.084 inch, 0.085 inch, 0.086 inch, 0.087 inch, 0.088 inch, 0.089 inch, 0.090 inch, 0.091 inch, 0.092 inch, 0.093 inch, 0.094 inch, 0.090 inch, 0.090 inch, 0.090 inch, 0.090 inch, 0.090 inch, 0.100 inch, 0.100 inch, 0.100 inch, 0.100 inch, 0.100 inch, 0.100 inch, 0.100 inch, 0.100 inch, 0.110 inch, 0.110 inch, 0.110 inch, 0.110 inch, 0.110 inch, 0.110 inch, 0.110 inch, 0.110 inch, 0.110 inch, 0.110 inch, or 0.120 inch.

The faceplate 114 can comprise a minimum thickness. In general, the faceplate lower portion 140 comprises the minimum thickness of the faceplate 114. In many embodiments, the faceplate 114 minimum thickness can be between approximately 0.050 inch and 0.080 inch. The minimum strikeface thickness can be between 0.050 inch and 0.055 inch, 0.055 inch and 0.060 inch, 0.060 inch and 0.065 inch, 0.065 inch and 0.070 inch, 0.070 inch and 0.075 inch, or 0.075 inch and 0.80 inch.

As discussed above, the faceplate lower portion 140 can comprise a variable thickness. In some embodiments, the faceplate lower portion 140 comprises a maximum lower portion thickness and a minimum lower portion thickness. In many embodiments, the maximum lower portion thickness can be between approximately 0.065 inch and 0.079 inch. The maximum lower portion thickness can be between 0.065 inch and 0.070 inch, 0.070 inch and 0.075 inch, or 0.075 inch and 0.079. In many embodiments, the minimum lower portion thickness can be between approximately 0.050 inch and 0.075 inch. The minimum lower portion thickness can be between 0.050 inch and 0.055 inch, 0.055 inch and 0.060 inch, 0.060 inch and 0.065 inch, 0.065 inch and 0.070 inch, or 0.070 inch and 0.075 inch. The faceplate lower portion thickness 142 across an entirety of the faceplate lower portion can be less than the minimum faceplate upper portion thickness 134.

In embodiments where the faceplate lower portion 140 comprises a constant thickness, the faceplate lower portion thickness can be between 0.05 inch and 0.079 inch. In some embodiments, the face plate lower portion thickness is between 0.050 inch and 0.055 inch, 0.055 inch and 0.060 inch, 0.060 inch and 0.065 inch, 0.065 inch and 0.070 inch, 0.070 inch and 0.075 inch or 0.075 inch and 0.079. In some embodiments, the lower portion thickness is less than 0.079 inch, 0.075 inch, 0.065 inch, 0.060 inch, 0.055 inch, or 0.050 inch. In other embodiments, the lower portion 140 thickness can be 0.050 inch, 0.051 inch, 0.052 inch, 0.053 inch, 0.054 inch, 0.055 inch, 0.056 inch, 0.057 inch, 0.058 inch, 0.059 inch, 0.060 inch, 0.061 inch, 0.062 inch, 0.063 inch, 0.064 inch, 0.065 inch, 0.066 inch, 0.067 inch, 0.068 inch, 0.069 inch, 0.070 inch, 0.071 inch, 0.072 inch, 0.073 inch, 0.074 inch, 0.075 inch, 0.076 inch, 0.077 inch, 0.078 inch, or 0.079 inch.

While the ranges disclosed above would appear to suggest overlap between the upper portion thicknesses and the lower portion thicknesses, for a given faceplate the lower portion thickness will always be less than a minimum thickness of the upper portion. The ranges disclosed above enable a combination of various faceplate 114 thicknesses, such as an upper portion minimum thickness of 0.07 inch and a lower portion maximum thickness of 0.065 inch, as well as a faceplate comprising an upper portion thickness of 0.08 inch and a lower portion maximum thickness of 0.079 inch. Thus, faceplates according to this disclosure will never have an upper portion thickness that is less than a lower portion thickness.

The faceplate upper portion can comprise a rear surface area between 1.7 $in^2$ and 2.6 $in^2$. In some embodiments, the faceplate upper portion can comprise a rear surface area between 1.7 $in^2$ and 1.8 $in^2$, 1.8 $in^2$ and 1.9 $in^2$, 1.9 $in^2$ and 2.0 $in^2$, 2.0 $in^2$ and 2.1 $in^2$, 2.1 $in^2$ and 2.2 $in^2$, 2.3 $in^2$ and 2.4 $in^2$, 2.4 $in^2$ and 2.5 $in^2$, 2.5 $in^2$ and 2.6 $in^2$, or 2.6 $in^2$ and 2.7 $in^2$.

The lower portion 140 can comprise a rear surface area between 0.6 $in^2$ and 1.1 $in^2$. In some embodiments the lower portion 140 can comprise a rear surface area between 0.6 $in^2$ and 0.7 $in^2$, 0.7 $in^2$ and 0.8 $in^2$, 0.8 $in^2$ and 0.9 $in^2$, 0.9 $in^2$ and 1.0 $in^2$, or 1.0 $in^2$ and 1.1 $in^2$.

A ratio between the upper portion rear surface area and the lower portion surface area can be between 1.5 to 4.5. In some embodiments, the ratio between the upper portion surface area and the lower portion surface area can be between 1.5 and 1.75, 1.75 and 2.0, 2.0 and 2.25, 2.25 and 2.5, 2.5 and 2.75, 2.75 and 3.0, 3.0 and 3.25, 3.25 and 3.5, 3.5 and 3.75, 3.75 and 4.0, 4.0 and 4.25, or 4.25 and 4.5. The ratio between the upper portion rear surface area and the lower portion rear surface area impacts the launch characteristics of a golf ball on center impacts and low impacts. For instance, greater lower portion rear surface area (a smaller ratio) can increase bending in the lower portion, whereas a lesser lower portion surface area (a greater ratio) can help maintain durability in the faceplate.

The faceplate can comprise a rear surface area between 3.2 $in^2$ and 3.7 $in^2$. In some embodiments the faceplate can comprise a rear surface area between 3.2 $in^2$ and 3.3 $in^2$, 3.3 $in^2$ and 3.4 $in^2$, 3.4 $in^2$ and 3.5 $in^2$, 3.5 $in^2$ and 3.6 $in^2$, or 3.6 $in^2$ and 3.7 $in^2$. The upper portion can comprise between 45% and 85% of the faceplate rear surface area. In some embodiments, the upper portion can comprise between 45% and 50%, 50% and 55%, 55% and 60%, 60% and 65%, 65% and 70%, 70% and 75%, 75% and 80%, or 80% and 85%. The lower portion can comprise between 15% and 55% of the faceplate rear surface area. In some embodiments, the lower portion can comprise between 15% and 20%, 20% and 25%, 25% and 30%, 30% and 35%, 35% and 40%, 40% and 45%, 45% and 50%, or 50% and 55%. The percentage the upper portion and the lower portion comprise of the faceplate rear surface are impacts the bending within the faceplate and in turn the ball speed different impact location generate.

Referring to FIG. 7, the faceplate 114 comprises a transition region 152. The transition region 152 can be located at or proximate the horizontal midline 1060 and creates a transition between the faceplate upper portion 132 and the faceplate lower portion 140. The transition region 152 provides a tapered thickness gradually transitioning from the faceplate upper portion thickness 134 to the faceplate lower portion thickness 142. The thinner lower portion thickness 142 (relative to the upper portion thickness 134) provides an increase in ball speed to golf balls struck in the lower portion 140. The transition region 152 can be located at or proximate the horizontal midline 1060 and creates a transition between the faceplate upper portion 132 and the faceplate lower portion 140. In some embodiments, the transition region 152 can further comprise a bevel or round at upper boundary and/or lower boundary. Rounding the boundaries of the transition region 152 can allow stress to flow smoothly through the transition region 152 and can reduce stress concentrations. In some embodiments, the transition region 152 can be a tiered transition region 152 comprising a plurality of distinct thickness tiers wherein each thickness tier is connected by a tier transition region 152. Some embodiments according to the present disclosure to not require a transition region 152 as there is no abrupt change in thickness that would require rounding the edges of each thickness region.

The golf club head 100 can include the rear body 116 coupled to any of the faceplates 114, 214, 314, 414, 514, 614, or 714 disclosed herein. Common elements of the golf club head 100 that can be used with any of the faceplates are designated with the same reference numbers. With respect to the faceplate examples, like reference numbers generally indicate identical, functionally similar, and/or structurally similar elements, with the reference numerals for each example having a common left most digit.

Figure 8:
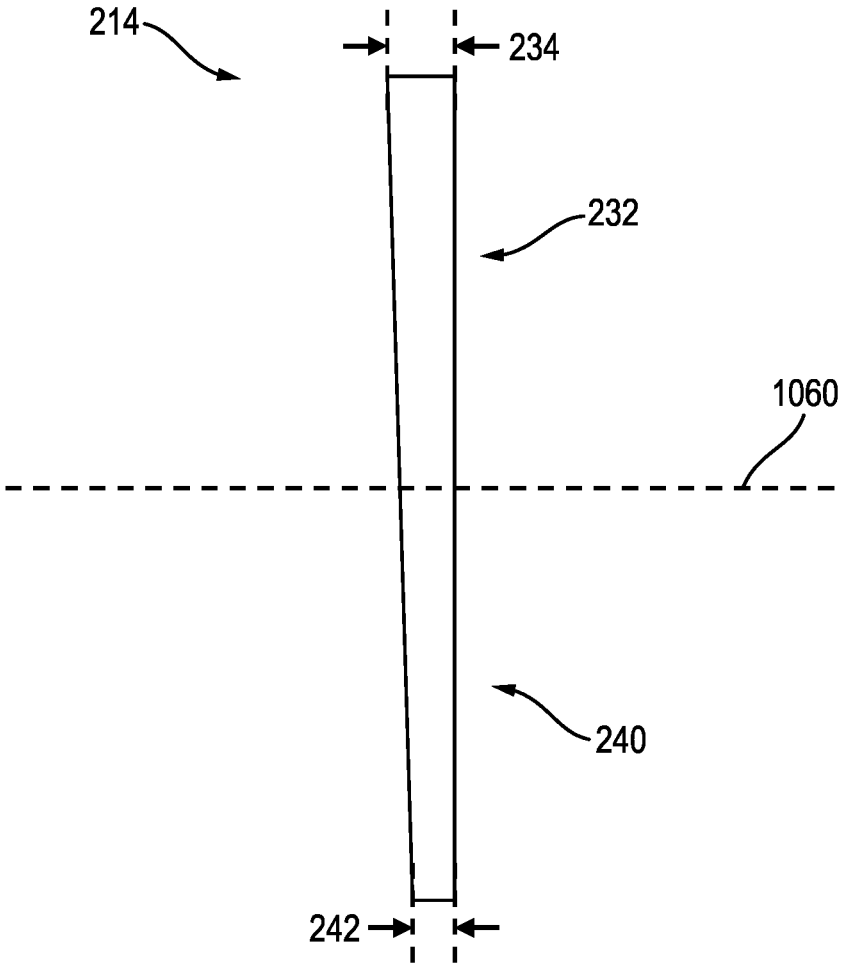
FIG. 8 illustrates a side view of a faceplate of the golf club head of FIG. 1, according to a second embodiment.

Referring to FIG. 8, a strike face 206 can comprise a faceplate 214 comprising a fully tapered thickness from the top of the faceplate 214 to the bottom of the faceplate 214. In this embodiment, the faceplate 214 can comprise a maximum thickness at the top of the faceplate upper portion 232 and a minimum thickness at the bottom of the faceplate lower portion 240. The faceplate 214 thickness can taper the entire way from the top of the faceplate 214 to the bottom of the faceplate 214. In some embodiments, the faceplate 214 can comprise a constant taper, wherein the thickness decreases at a constant rate from the top of the faceplate 214 to the bottom of the faceplate 214. In other embodiments, the faceplate 214 can comprise a variable taper, wherein different portions of the faceplate 214 comprise thicknesses changing at different rates. The faceplate 214 comprising a tapered variable face thickness provided an case in manufacturing when compared to a more complex variable face thickness while still providing an increase in in ball speed to golf balls struck in the lower portion 240.

In many embodiments, the faceplate 214 maximum thickness can be between approximately 0.080 inch and 0.120 inch. The maximum face thickness can be between 0.080 inch and 0.085 inch, 0.085 inch and 0.090 inch, 0.090 inch and 0.095 inch, 0.095 inch and 0.100 inch, 0.100 inch and 0.105 inch, 0.105 inch and 0.110 inch, 0.0110 inch and 0.115 inch, or 0.115 inch and 0.120 inch.

In some embodiments, the faceplate upper portion 232 comprises multiple thicknesses including a maximum upper portion thickness and a minimum upper portion thickness. In many embodiments, the maximum upper portion thickness can be between approximately 0.080 inch and 0.120 inch. The maximum upper portion thickness can be between 0.080 inch and 0.085 inch, 0.085 inch and 0.090 inch, 0.090 inch and 0.095 inch, 0.095 inch and 0.100 inch, 0.100 inch and 0.105 inch, 0.105 inch and 0.110 inch, 0.0110 inch and 0.115 inch, or 0.115 inch and 0.120 inch. In some embodiments, the minimum upper portion thickness can be between approximately 0.070 inch and 0.090 inch. The minimum upper portion thickness can be between 0.070 inch 0.075 inch, 0.075 inch and 0.080 inch, 0.080 inch and 0.085 inch, or 0.085 inch and 0.090 inch. The faceplate upper portion thickness 234 across an entirety of the faceplate upper portion can greater than the maximum faceplate lower portion thickness.

The faceplate lower portion 240 comprises the minimum thickness of the faceplate 214. In many embodiments, the minimum strike face thickness can be between approximately 0.050 inch and 0.079 inch. The minimum strike face thickness can be between 0.050 inch and 0.055 inch, 0.055 inch and 0.060 inch, 0.060 inch and 0.065 inch, 0.065 inch and 0.070 inch, 0.070 inch and 0.075 inch, or 0.075 inch and 0.079 inch.

In some embodiments, the faceplate lower portion 240 comprises a maximum lower portion thickness and a minimum lower portion thickness. In many embodiments, the maximum lower portion thickness can be between approximately 0.065 inch and 0.079 inch. The maximum lower portion thickness can be between 0.065 inch and 0.070 inch, 0.070 inch and 0.075 inch, or 0.075 inch and 0.079. In many embodiments, the minimum lower portion thickness can be between approximately 0.050 inch and 0.075 inch. The minimum lower portion thickness can be between 0.050 inch and 0.055 inch, 0.055 inch and 0.060 inch, 0.060 inch and 0.065 inch, 0.065 inch and 0.070 inch, or 0.070 inch and 0.075 inch. The faceplate lower portion thickness 242 across an entirety of the faceplate lower portion can be less than the minimum faceplate upper portion thickness 234.

Figure 9:
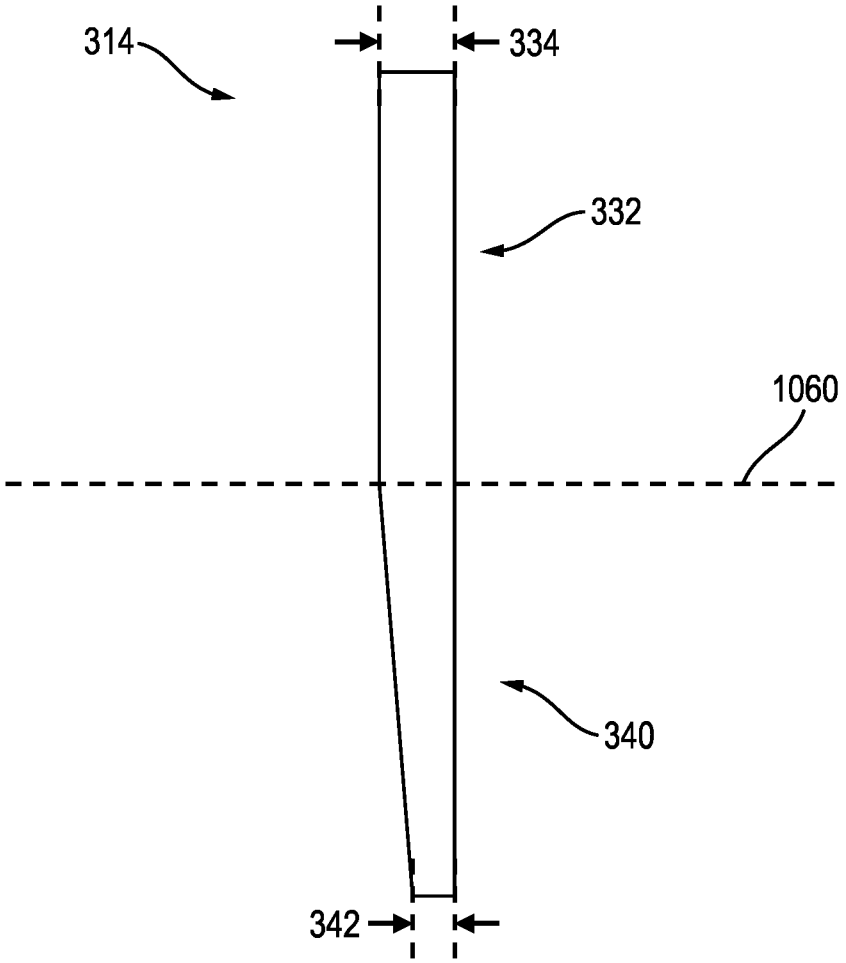
FIG. 9 illustrates a side view of the faceplate of the golf club head of FIG. 1, according to a third embodiment.

Referring to FIG. 9, a strike face 306 can comprise a faceplate 314 comprising a descending faceplate 314 thickness. In the present embodiment, the faceplate 314 can comprise a faceplate upper portion 332 with a uniform or substantially constant thickness and a faceplate lower portion 340 with a tapered thickness. In many embodiments, the faceplate upper portion thickness 334 can be greater than the maximum lower portion thickness 342. In many embodiments, maximum lower portion thickness 342 occurs at or proximate the horizontal midline 1060, or at the interface between the faceplate upper portion 332 and the faceplate lower portion 340. The faceplate lower portion thickness 342 can taper from the horizontal midline 1060 to the bottom of the faceplate lower portion 340. In some embodiments, the faceplate lower portion 340 can comprise a constant taper wherein the thickness decreases at a consistent rate from the top of the horizontal midline 1060 to the bottom of the faceplate lower portion 340. In other embodiments, the faceplate lower portion 340 can comprise a variable taper wherein different portions of the faceplate lower portion 340 comprise thicknesses changing at different rates. Providing a tapered thickness over the lower portion 340 of the faceplate 314 can be advantageous in providing stress relief and durability. The tapered faceplate lower portion 340 can allow the bottom of the faceplate 314 to be thinned without providing an abrupt transition between the thick faceplate upper portion 332 and the faceplate lower portion 340 that can compromise the durability of the strike face 306.

In many embodiments, the faceplate 314 maximum thickness can be between approximately 0.080 inch and 0.120 inch. The maximum face thickness can be between 0.080 inch and 0.085 inch, 0.085 inch and 0.090 inch, 0.090 inch and 0.095 inch, 0.095 inch and 0.100 inch, 0.100 inch and 0.105 inch, 0.105 inch and 0.110 inch, 0.0110 inch and 0.115 inch, or 0.115 inch and 0.120 inch.

In some embodiments, the faceplate upper portion 332 comprises multiple thicknesses including a maximum upper portion thickness 334 and a minimum upper portion thickness 334. In many embodiments, the maximum upper portion thickness 334 can be between approximately 0.080 inch and 0.120 inch. The maximum upper portion thickness can be between 0.080 inch and 0.085 inch, 0.085 inch and 0.090 inch, 0.090 inch and 0.095 inch, 0.095 inch and 0.100 inch, 0.100 inch and 0.105 inch, 0.105 inch and 0.110 inch, 0.0110 inch and 0.115 inch, or 0.115 inch and 0.120 inch. In many embodiments, the minimum upper portion thickness 334 can be between approximately 0.070 inch and 0.090 inch. The minimum upper portion thickness can be between 0.070 inch 0.075 inch, 0.075 inch and 0.080 inch, 0.080 inch and 0.085 inch, or 0.085 inch and 0.090 inch. The faceplate upper portion thickness 334 across an entirety of the faceplate upper portion can be greater than the maximum faceplate lower portion thickness 342. The thickness relationship between the upper and lower portion thicknesses 334, 342 can be beneficial in increasing ball speed on off-center hits while retaining the facial support and durability required of a golf club.

The faceplate lower portion 340 comprises the minimum thickness of the faceplate 314. In many embodiments, the faceplate 314 minimum thickness can be between approximately 0.050 inch and 0.079 inch. The minimum strike face thickness can be between 0.050 inch and 0.055 inch, 0.055 inch and 0.060 inch, 0.060 inch and 0.065 inch, 0.065 inch and 0.070 inch, 0.070 inch and 0.075 inch, or 0.075 inch and 0.079 inch.

In some embodiments, the faceplate lower portion 340 comprises multiple thicknesses including a maximum lower portion thickness 342 and a minimum lower portion thickness 342. In many embodiments, the maximum lower portion thickness 342 can be between approximately 0.065 inch and 0.079 inch. The maximum lower portion thickness can be between 0.065 inch and 0.070 inch, 0.070 inch and 0.075 inch, or 0.075 inch and 0.079. In many embodiments, the minimum lower portion thickness 342 can be between approximately 0.050 inch and 0.075 inch. The minimum lower portion thickness can be between 0.050 inch and 0.055 inch, 0.055 inch and 0.060 inch, 0.060 inch and 0.065 inch, 0.065 inch and 0.070 inch, or 0.070 inch and 0.075 inch. The faceplate lower portion thickness 342 across an entirety of the faceplate lower portion can less than the minimum faceplate upper portion thickness 334.

Figure 10:
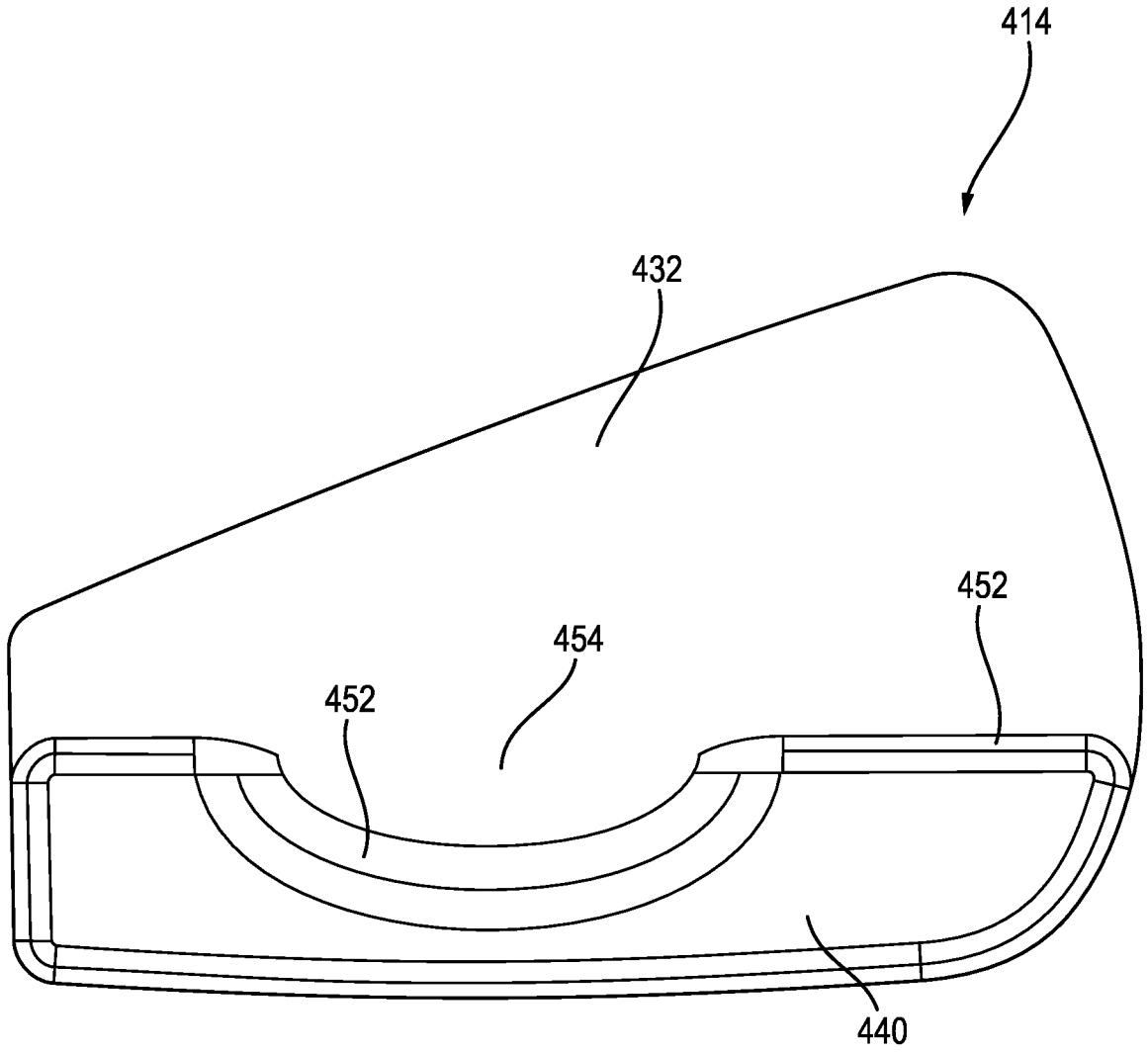
FIG. 10 illustrates a rear-cutaway view of the golf club head of FIG. 1, according to a fourth embodiment.

FIG. 10 depicts another embodiment of a golf club head 400 comprising a descending faceplate 414 thickness. Similar to previous embodiments, a strike face 406 can comprise a faceplate 414 comprising a uniform upper portion thickness 434. Referring to FIG. 10, the faceplate 414 comprises a reinforcement region 454. The reinforcement region 454 can be located proximate to the geometric face center 428, in a heel-to-toe direction, and can protrude from the faceplate upper portion 432 down into the faceplate lower portion 440. The reinforcement region provides structural support to impacts proximate the geometric face center. In many embodiments, the reinforcement region 454 comprises a thickness equal or similar to the faceplate upper portion thickness 434, as illustrated in the embodiment of FIG. 10. The reinforcement region 454 is a different region than both the upper portion 432 and the lower portion 440. In some embodiments, the reinforcement region 454 can comprise a thickness between 0.060 inch and 0.080 inch, 0.060 inch, 0.060 inch and 0.065 inch, 0.065 inch and 0.070 inch, 0.070 inch and 0.075 inch, or 0.075 inch and 0.080 inch. In some embodiments, the reinforcement region 454 can comprise a thickness greater than 0.060 inch, greater than 0.065 inch, greater than 0.070 inch, or greater than 0.075 inch. In alternative embodiments, the reinforcement region 454 can comprise an ovular shape, an ellipsoidal shape, a square shape, a triangular shape, a rectangular shape, or any other suitable shape and is not limited to a circular shape.

The reinforcement region 454 provides extra support around the geometric face center 428 of the strike face 406. The extra support provided by the reinforcement region 454 allows the remainder of the faceplate lower portion 440 to be provided with a substantially thin thickness. In some embodiments, the thickness of the faceplate lower portion 440 outside of the reinforcement region 454 can be less than approximately 0.075 inch, 0.070 inch 0.065 inch, 0.060 inch, 0.055 inch, or 0.050 inch.

The reinforcement region 454 can further comprise a reinforcement surface area. The reinforcement surface area can be between 0.20 inches and 0.60 inches. The reinforcement surface area can be between 0.20 inches and 0.25 inches, 0.25 inches and 0.30 inches, 0.30 inches and 0.35 inches, 0.35 inches and 0.40 inches, 0.40 inches and 0.45 inches, 0.45 inches and 0.50 inches, 0.50 inches and 0.55 inches, or 0.55 inches and 0.60 inches. The reinforcement surface area can be manipulated to increase or decrease the surface area of the lower portion or upper portion as desired to provide more consistent ball speed throughout the strikeface.

As discussed above the faceplate can comprise a rear surface area. The reinforcement surface area can comprise between 4% and 17% of the faceplate rear surface area. The reinforcement surface area can comprise between 4% and 5%, 5% and 6%, 6% and 7%, 7% and 8%, 8% and 9%, 9% and 10%, 10% and 11%, 11% and 12%, 12% and 13%, or 13% and 14% of the faceplate rear surface area.

Similar to previous embodiments, the faceplate 414 comprising a reinforcement region 454 can comprise a transition region 452. Referring to FIG. 10, wherein the reinforcement region 454 and the faceplate upper portion 432 comprise a similar thickness, the faceplate 414 can comprise a single transition region 452. The transition region 452 forms a boundary between the faceplate upper portion 432 and the faceplate lower portion 440 as well as a boundary between the reinforcement region 454 and the faceplate lower portion 440. As such, the transition region 452 extends along the lower boundary of the faceplate upper portion 432 towards the heel 108 and toe 110 and follows the contour of the reinforcement region 454 near the geometric face center 428 of the strike face 406. The transition region 452 gradually tapers between the thicknesses of the faceplate upper portion 432, the reinforcement region 454, and the faceplate lower portion 440. The thinner lower portion 440 thickness (relative to the upper portion 432 thickness and reinforcement region 454 thickness) provides an increase in ball speed to golf balls struck in the lower portion 440.

In some embodiments, the faceplate 414 maximum thickness can be between approximately 0.080 inch and 0.120 inch, 0.080 inch and 0.085 inch, 0.085 inch and 0.090 inch, 0.090 inch and 0.095 inch, 0.095 inch and 0.100 inch, 0.100 inch and 0.105 inch, 0.105 inch and 0.110 inch, 0.0110 inch and 0.115 inch, or 0.115 inch and 0.120 inch. In some embodiments, the faceplate upper portion 432 comprises multiple thicknesses including a maximum upper portion thickness 434 and a minimum upper portion thickness 434. In many embodiments, the maximum upper portion thickness 434 can be between approximately 0.080 inch and 0.120 inch, 0.080 inch and 0.085 inch, 0.085 inch and 0.090 inch, 0.090 inch and 0.095 inch, 0.095 inch and 0.100 inch, 0.100 inch and 0.105 inch, 0.105 inch and 0.110 inch, 0.0110 inch and 0.115 inch, or 0.115 inch and 0.120 inch. In many embodiments, the minimum upper portion thickness 434 can be between approximately 0.070 inch and 0.090 inch, 0.070 inch 0.075 inch, 0.075 inch and 0.080 inch, 0.080 inch and 0.085 inch, or 0.085 inch and 0.090 inch.

The faceplate lower portion 440 comprises the minimum thickness of the faceplate 414. In many embodiments, the faceplate 414 minimum thickness can be between approximately 0.050 inch and 0.079 inch, 0.050 inch and 0.055 inch, 0.055 inch and 0.060 inch, 0.060 inch and 0.065 inch, 0.065 inch and 0.070 inch, 0.070 inch and 0.075 inch, or 0.075 inch and 0.079 inch. In some embodiments, the faceplate lower portion 440 comprises multiple thicknesses including a maximum lower portion 440 thickness and a minimum lower portion 440 thickness. In many embodiments, the maximum lower portion 440 thickness can be between approximately 0.065 inch and 0.079 inch, 0.065 inch and 0.070 inch, 0.070 inch and 0.075 inch, or 0.075 inch and 0.079. In many embodiments, the minimum lower portion 440 thickness can be between approximately 0.050 inch and 0.075 inch, 0.050 inch and 0.055 inch, 0.055 inch and 0.060 inch, 0.060 inch and 0.065 inch, 0.065 inch and 0.070 inch, or 0.070 inch and 0.075 inch. The faceplate lower portion 440 thickness across an entirety of the faceplate lower portion 440 can be less than the minimum faceplate upper portion 432 thickness.

Figure 11:
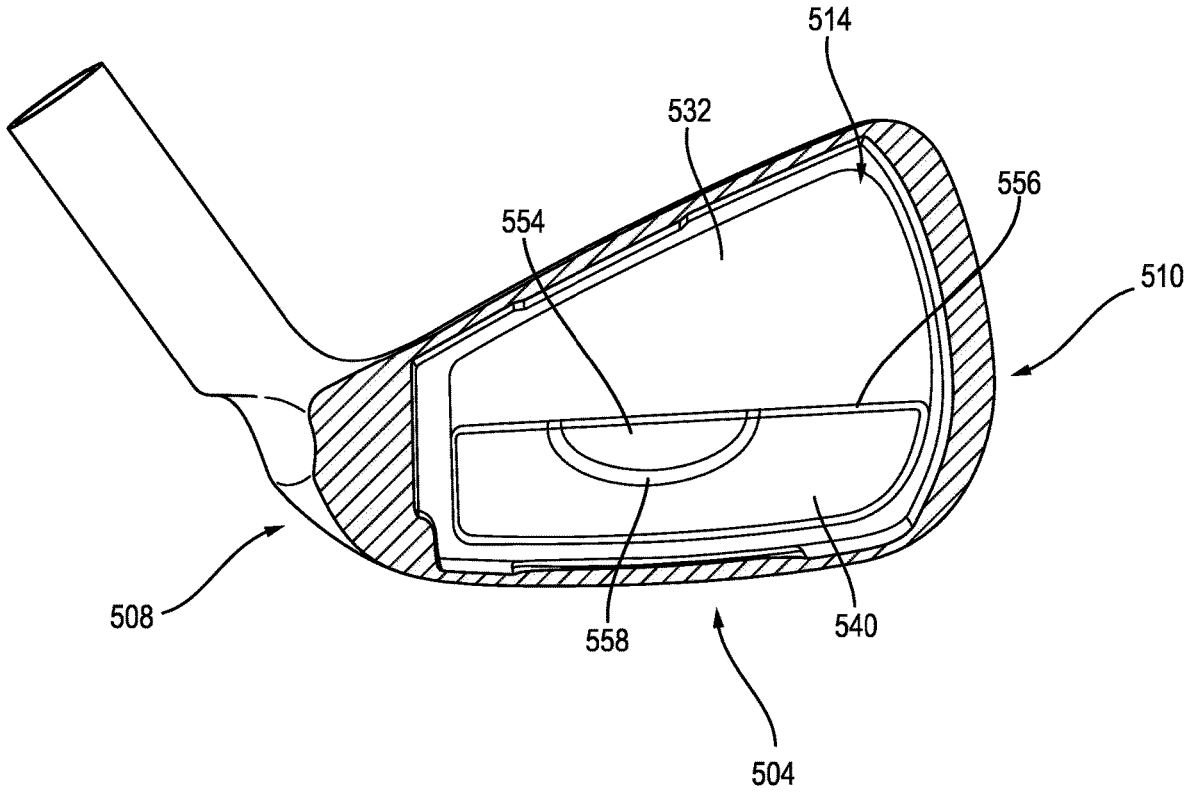
FIG. 11 illustrates a rear view of a faceplate of the golf club head of FIG. 1, according to a fifth embodiment.

In another embodiment, a strike plate 506 can comprise a faceplate 514. The faceplate 514 can comprise a reinforcement region 554 that comprises a thickness less than the thickness of the faceplate upper portion 532, such as the embodiment illustrated in FIG. 11. The reinforcement region provides structural support to impacts proximate the geometric face center. The reinforcement region 554 is a different region than both the upper portion 532 and the lower portion 540. As illustrated in FIG. 11, the faceplate 514 can comprise multiple transition regions. For instance, the faceplate 514 can comprise an upper portion transition region 556 extending along the entire lower boundary of the faceplate upper portion 532 and a reinforcement transition region 558 extending along the bottom perimeter of the transition region. The faceplate upper portion transition region 556 provides a gradual change in thickness between the faceplate upper portion 532 and the faceplate lower portion 540 towards the heel end 508 and toe end 510 of the faceplate 514 as well as a gradual change in thickness between the faceplate upper portion 532 and the reinforcement region 554. The reinforcement transition region 558 provides a gradual change in thickness between the reinforcement region 554 and the faceplate lower portion 540. In alternative embodiments, the reinforcement region 554 can comprise an ovular shape, an ellipsoidal shape, a square shape, a triangular shape, a rectangular shape, or any other suitable shape and is not limited to a circular shape.

In many embodiments, the faceplate lower portion 540 can comprise a substantially constant thickness. In other embodiments, the faceplate lower portion 540 can comprise a tapering thickness. In many embodiments, the faceplate lower portion 540 comprises a lower portion maximum thickness proximate the midline and a lower portion minimum thickness proximate the sole 504.

The reinforcement region 554 provides extra support around the geometric face center 528 of the strike face 506. The extra support provided by the reinforcement region 554 allows the remainder of the faceplate lower portion 540 to be provided with a substantially thin thickness. In some embodiments, the thickness of the faceplate lower portion 540 outside of the reinforcement region 554 can be less than approximately 0.075 inch, 0.070 inch 0.065 inch, 0.060 inch, 0.055 inch, or 0.050 inch.

The reinforcement region 554 can further comprise a reinforcement surface area. The reinforcement surface area can be between 0.20 inches and 0.60 inches. The reinforcement surface area can be between 0.20 inches and 0.25 inches, 0.25 inches and 0.30 inches, 0.30 inches and 0.35 inches, 0.35 inches and 0.40 inches, 0.40 inches and 0.45 inches, 0.45 inches and 0.50 inches, 0.50 inches and 0.55 inches, or 0.55 inches and 0.60 inches. The reinforcement surface area can be manipulated to increase or decrease the surface area of the lower portion or upper portion as desired to provide more consistent ball speed throughout the strikeface.

As discussed above the faceplate can comprise a rear surface area. The reinforcement surface area can comprise between 4% and 17% of the faceplate rear surface area. The reinforcement surface area can comprise between 4% and 5%, 5% and 6%, 6% and 7%, 7% and 8%, 8% and 9%, 9% and 10%, 10% and 11%, 11% and 12%, 12% and 13%, or 13% and 14% of the faceplate rear surface area.

In many embodiments, the faceplate 514 maximum thickness can be between approximately 0.080 inch and 0.120 inch, 0.080 inch and 0.085 inch, 0.085 inch and 0.090 inch, 0.090 inch and 0.095 inch, 0.095 inch and 0.100 inch, 0.100 inch and 0.105 inch, 0.105 inch and 0.110 inch, 0.0110 inch and 0.115 inch, or 0.115 inch and 0.120 inch. In some embodiments, the faceplate upper portion 532 comprises multiple thicknesses including a maximum upper portion thickness 534 and a minimum upper portion thickness 534. In many embodiments, the maximum upper portion thickness 534 can be between approximately 0.080 inch and 0.120 inch, 0.080 inch and 0.085 inch, 0.085 inch and 0.090 inch, 0.090 inch and 0.095 inch, 0.095 inch and 0.100 inch, 0.100 inch and 0.105 inch, 0.105 inch and 0.110 inch, 0.0110 inch and 0.115 inch, or 0.115 inch and 0.120 inch. In many embodiments, the minimum upper portion thickness 534 can be between approximately 0.070 inch and 0.090 inch, 0.070 inch 0.075 inch, 0.075 inch and 0.080 inch, 0.080 inch and 0.085 inch, or 0.085 inch and 0.090 inch.

The faceplate lower portion 540 comprises the minimum thickness of the faceplate 514. In many embodiments, the faceplate 514 minimum thickness can be between approximately 0.050 inch and 0.079 inch, 0.050 inch and 0.055 inch, 0.055 inch and 0.060 inch, 0.060 inch and 0.065 inch, 0.065 inch and 0.070 inch, or 0.070 inch and 0.075 inch, or 0.075 inch and 0.079 inch. In some embodiments, the faceplate lower portion 540 comprises multiple thicknesses including a maximum lower portion thickness and a minimum lower portion thickness. In many embodiments, the maximum lower portion 540 thickness can be between approximately 0.065 inch and 0.079 inch, 0.065 inch and 0.070 inch, 0.070 inch and 0.075 inch, or 0.075 inch and 0.079. In many embodiments, the minimum lower portion 540 thickness can be between approximately 0.050 inch and 0.075 inch, 0.050 inch and 0.055 inch, 0.055 inch and 0.060 inch, 0.060 inch and 0.065 inch, 0.065 inch and 0.070 inch, or 0.070 inch and 0.075 inch. The faceplate lower portion 540 thickness across an entirety of the faceplate lower portion can be less than the minimum faceplate upper portion 532 thickness. The thinner lower portion 540 thickness (relative to the upper portion 532 thickness and reinforcement region 554 thickness) provides an increase in ball speed to golf balls struck in the lower portion 540.

Figure 12:
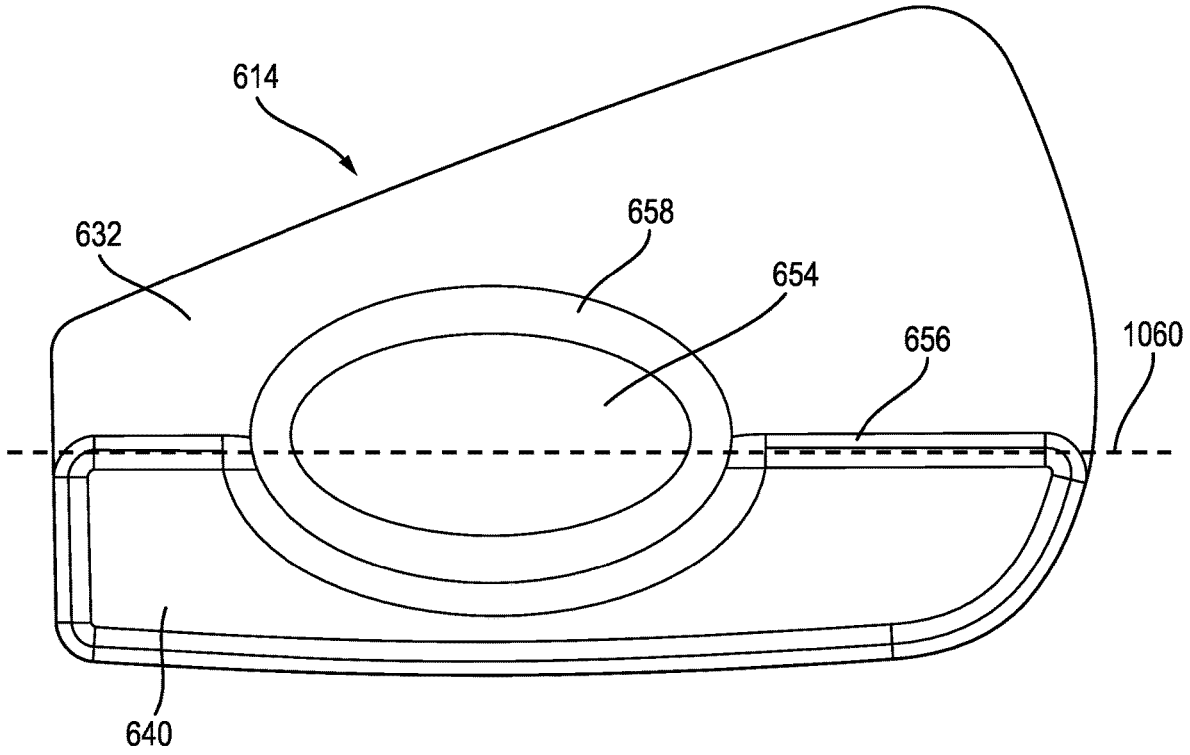
FIG. 12 illustrates a rear view of the golf club head of FIG. 1, according to a sixth embodiment.
Figure 13:
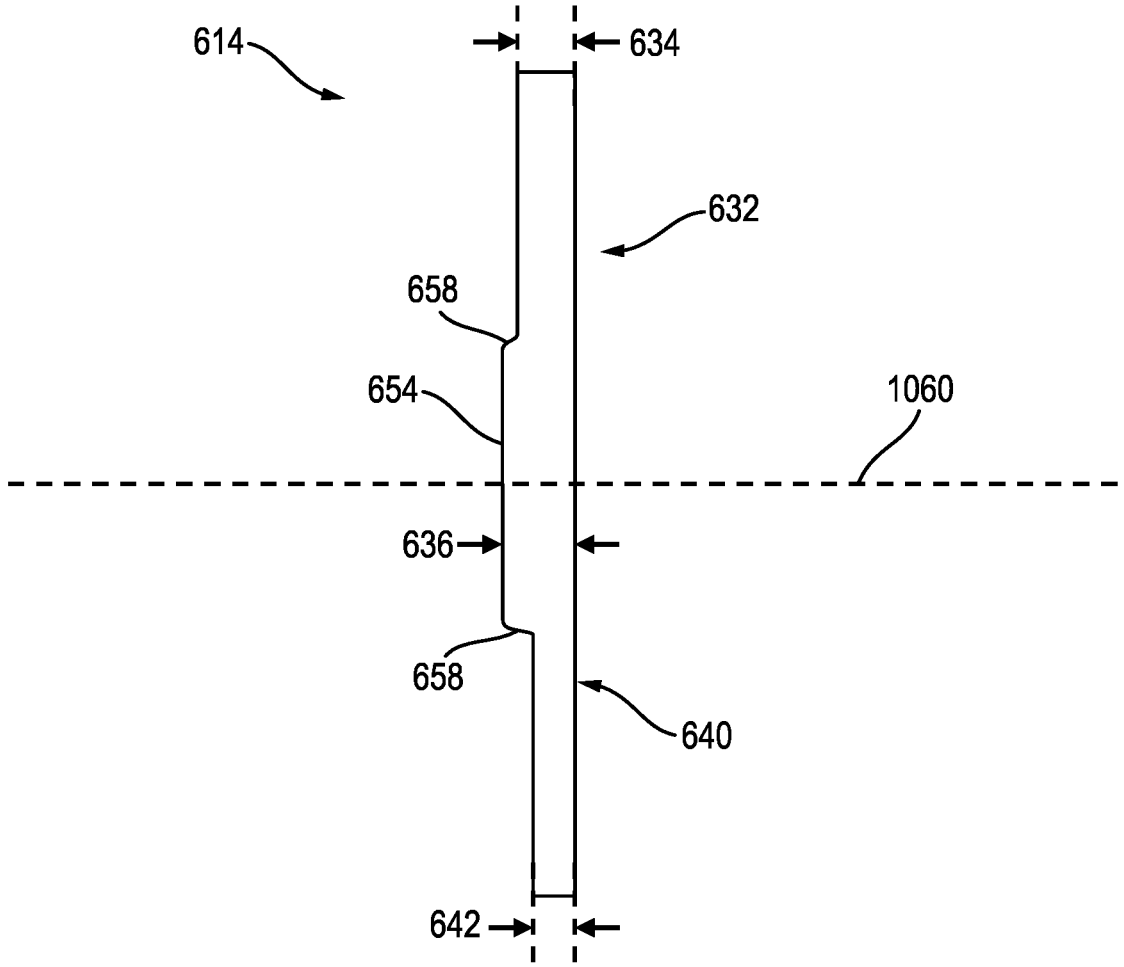
FIG. 13 illustrates a side view of a faceplate of the golf club head of FIG. 1, according to the sixth embodiment.

Referring now to FIGS. 12 and 13, in some embodiments, a strike face 606 can comprise a faceplate 614 comprising a reinforcement region 654 that comprises a maximum thickness of the faceplate 614. In the illustrated embodiment, the reinforcement region 654 protrudes from both the faceplate upper portion 632 and the faceplate lower portion 640 into the interior cavity 626 such that the reinforcement region 654 is thicker than both the faceplate upper portion 632 and the faceplate lower portion 640. The reinforcement region 654 is a different region than both the upper portion 632 and the lower portion 640. The reinforcement region 654 provides structural support to impacts proximate the geometric face center. The illustrated embodiment of FIGS. 12 and 13 illustrates the reinforcement region 654 as a circle, wherein a portion of the reinforcement region 654 is provided above the horizontal midline 1060 and a portion of the reinforcement region 654 is provided below the horizontal midline 1060. In alternative embodiments, the reinforcement region 654 can be provided entirely above the horizontal midline 1060 or entirely below the horizontal midline 1060. In alternative embodiments, the reinforcement region 654 can comprise an ovular shape, an ellipsoidal shape, a square shape, a triangular shape, a rectangular shape, or any other suitable shape and is not limited to a circular shape. Providing extra thickness to the reinforcement region 654 can allow both the upper and lower portion 640 to be thinned without compromising the structural integrity of the faceplate 614.

As discussed above, the reinforcement region 654 can comprise the maximum thickness of the faceplate 614. In some embodiments, the reinforcement region 654 comprises a thickness 636 greater than approximately 0.090 inch, 0.095 inch, 0.100 inch, 0.105 inch, 0.110 inch, 0.115 inch, or 0.120 inch.

The faceplate 614 of FIGS. 12 and 13 comprises multiple transition regions. The faceplate 614 can comprise a reinforcement transition region 658 and an upper portion transition region 656. The reinforcement transition region 658 forms a gradual change in thickness between the reinforcement region 654 and the remainder of the faceplate 614. The portion of the reinforcement transition region 658 above the horizontal midline 1060 provides a transition between the reinforcement region 654 and the faceplate upper portion 632 of the faceplate 614. The portion of the reinforcement transition region 658 below the horizontal midline 1060 provides a transition between the reinforcement region 654 and the faceplate lower portion 640 of the faceplate 614. The faceplate upper portion transition region 656 provides a gradual change in thickness between the faceplate upper portion 632 and the faceplate lower portion 640 towards the heel 108 and the toe 110.

The reinforcement region 654 provides extra support around the geometric face center 628 of the strike face 606. The extra support provided by the reinforcement region 654 allows the remainder of the faceplate lower portion 640 to be provided with a substantially thin thickness. In some embodiments, the thickness of the faceplate lower portion 640 outside of the reinforcement region 654 can be less than approximately 0.075 inch, 0.070 inch 0.065 inch, 0.060 inch, 0.055 inch, or 0.050 inch.

The reinforcement region 654 can further comprise a reinforcement surface area. The reinforcement surface area can be between 0.20 inches and 0.60 inches. The reinforcement surface area can be between 0.20 inches and 0.25 inches, 0.25 inches and 0.30 inches, 0.30 inches and 0.35 inches, 0.35 inches and 0.40 inches, 0.40 inches and 0.45 inches, 0.45 inches and 0.50 inches, 0.50 inches and 0.55 inches, or 0.55 inches and 0.60 inches. The reinforcement surface area can be manipulated to increase or decrease the surface area of the lower portion or upper portion as desired to provide more consistent ball speed throughout the strikeface.

As discussed above the faceplate 614 can comprise a rear surface area. The reinforcement surface area can comprise between 4% and 17% of the faceplate rear surface area. The reinforcement surface area can comprise between 4% and 5%, 5% and 6%, 6% and 7%, 7% and 8%, 8% and 9%, 9% and 10%, 10% and 11%, 11% and 12%, 12% and 13%, or 13% and 14% of the faceplate rear surface area.

In many embodiments, the faceplate 614 maximum thickness can be between approximately 0.080 inch and 0.120 inch, 0.080 inch and 0.085 inch, 0.085 inch and 0.090 inch, 0.090 inch and 0.095 inch, 0.095 inch and 0.100 inch, 0.100 inch and 0.105 inch, 0.105 inch and 0.110 inch, 0.0110 inch and 0.115 inch, or 0.115 inch and 0.120 inch. In some embodiments, the faceplate upper portion 632 comprises multiple thicknesses including a maximum upper portion thickness 634 and a minimum upper portion thickness 634. In many embodiments, the maximum upper portion thickness 634 can be between approximately 0.080 inch and 0.120 inch, 0.080 inch and 0.085 inch, 0.085 inch and 0.090 inch, 0.090 inch and 0.095 inch, 0.095 inch and 0.100 inch, 0.100 inch and 0.105 inch, 0.105 inch and 0.110 inch, 0.0110 inch and 0.115 inch, or 0.115 inch and 0.120 inch. In many embodiments, the minimum upper portion thickness 634 can be between approximately 0.070 inch and 0.090 inch, 0.070 inch 0.075 inch, 0.075 inch and 0.080 inch, 0.080 inch and 0.085 inch, or 0.085 inch and 0.090 inch.

The faceplate lower portion 640 comprises the minimum thickness of the faceplate 614. In many embodiments, the faceplate 614 minimum thickness can be between approximately 0.050 inch and 0.079 inch, 0.050 inch and 0.055 inch, 0.055 inch and 0.060 inch, 0.060 inch and 0.065 inch, 0.065 inch and 0.070 inch, 0.070 inch and 0.075 inch, or 0.075 inch and 0.079 inch. In some embodiments, the faceplate lower portion 640 comprises multiple thicknesses including a maximum lower portion thickness 642 and a minimum lower portion thickness 642. In many embodiments, the maximum lower portion thickness 642 can be between approximately 0.065 inch and 0.079 inch, 0.065 inch and 0.070 inch, 0.070 inch and 0.075 inch, or 0.075 inch and 0.079. In many embodiments, the minimum lower portion thickness 642 can be between approximately 0.050 inch and 0.075 inch, 0.050 inch and 0.055 inch, 0.055 inch and 0.060 inch, 0.060 inch and 0.065 inch, 0.065 inch and 0.070 inch, or 0.070 inch and 0.075 inch. The faceplate lower portion thickness 642 across an entirety of the faceplate lower portion can be less than the minimum faceplate upper portion thickness 634.

Figure 14:
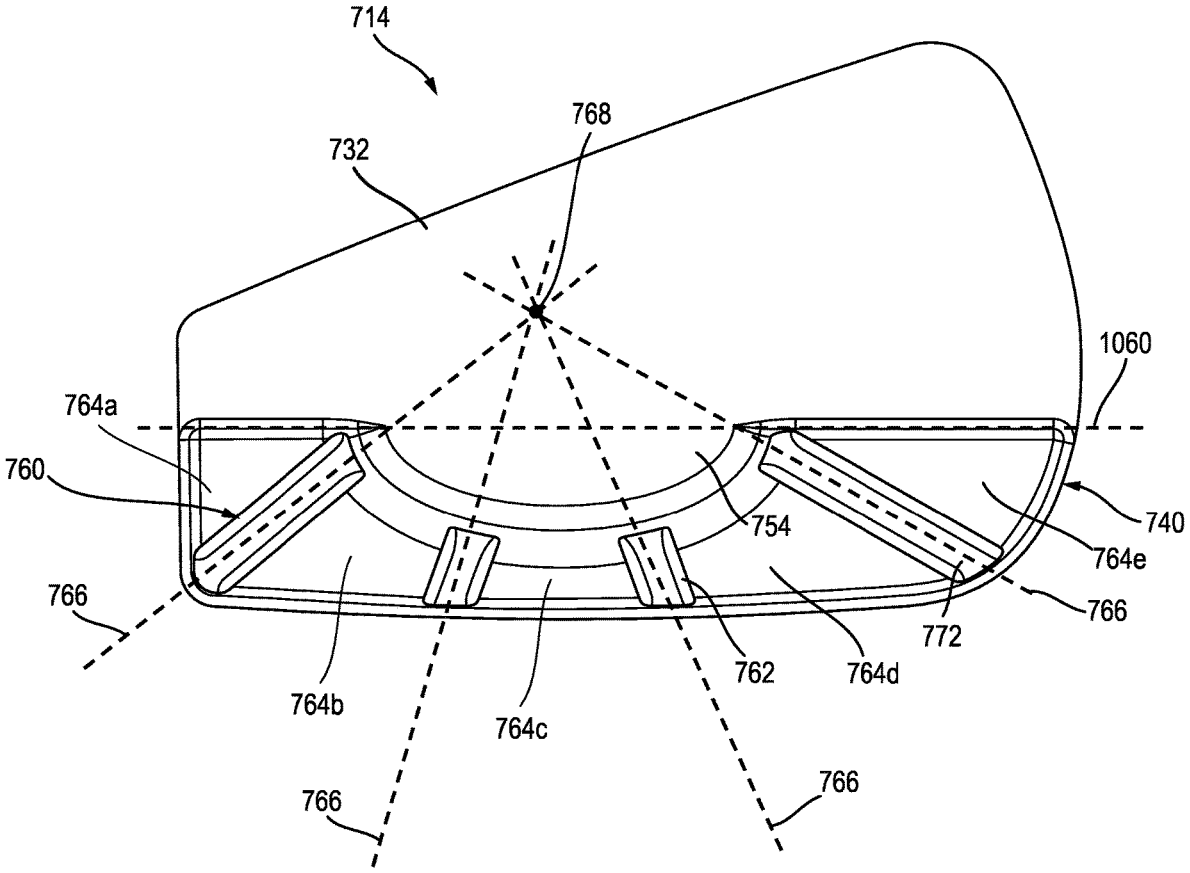
FIG. 14 illustrates a rear view of the golf club head of FIG. 1, according to a seventh embodiment.

FIG. 14 illustrates another embodiment of a faceplate 714 comprising a descending thickness. The embodiment of FIG. 14 comprises an upper portion 732 of uniform thickness and reinforcement region 754 comprising a thickness equal to or slightly less than that of the faceplate upper portion 732, similar to various embodiments described above. The reinforcement region 754 is a different region than both the upper portion 732 and the lower portion 740. The reinforcement region 754 provides structural support to impacts proximate the geometric face center. In some embodiments, the reinforcement region 754 can comprise an ovular shape, an ellipsoidal shape, a square shape, a triangular shape, a rectangular shape, or any other suitable shape and is not limited to a circular shape.

The reinforcement region 754 provides extra support around the geometric face center 728 of the strike face 706. The extra support provided by the reinforcement region 754 allows the remainder of the faceplate lower portion 740 to be provided with a substantially thin thickness. In some embodiments, the thickness of the faceplate lower portion 440 outside of the reinforcement region 754 can be less than approximately 0.075 inch, 0.070 inch 0.065 inch, 0.060 inch, 0.055 inch, or 0.050 inch.

The reinforcement region 754 can further comprise a reinforcement surface area. The reinforcement surface area can be between 0.20 inches and 0.60 inches. The reinforcement surface area can be between 0.20 inches and 0.25 inches, 0.25 inches and 0.30 inches, 0.30 inches and 0.35 inches, 0.35 inches and 0.40 inches, 0.40 inches and 0.45 inches, 0.45 inches and 0.50 inches, 0.50 inches and 0.55 inches, or 0.55 inches and 0.60 inches. The reinforcement surface area can be manipulated to increase or decrease the surface area of the lower portion or upper portion as desired to provide more consistent ball speed throughout the strikeface.

As discussed above the faceplate can comprise a rear surface area. The reinforcement surface area can comprise between 4% and 17% of the faceplate rear surface area. The reinforcement surface area can comprise between 4% and 5%, 5% and 6%, 6% and 7%, 7% and 8%, 8% and 9%, 9% and 10%, 10% and 11%, 11% and 12%, 12% and 13%, or 13% and 14% of the faceplate rear surface area.

The faceplate lower portion 740 of the illustrated embodiment further comprises a plurality of lower portion ribs 760. In some embodiments, the plurality of lower portion ribs 760 can comprise, one, two, three, four, five, or six ribs. The faceplate lower portion ribs 760 are thick sections extending through the faceplate lower portion 740 and connecting the faceplate upper portion 732 and reinforcement region 754 to the lower perimeter of the faceplate 714. The faceplate lower portion ribs 760 can comprise a thickness similar to or less than the faceplate upper portion 732 and/or the reinforcement region 754. Between each adjacent rib, the faceplate lower portion 740 comprises a plurality of thin sections 764*a*, 764*b*, 764*c*, 764*d*, and 764*c*. The faceplate lower portion ribs 760 reinforce the faceplate lower portion 740 of the faceplate 714 and allow the remainder of the faceplate lower portion 740 (i.e. the thin sections 764*a*, 764*b*, 764*c*, 764*d*, and 764*c*) to be thinned relative to the faceplate lower portion 740 of a strike face devoid of the ribs. In some embodiments, the thin sections 764*a*, 764*b*, 764*c*, 764*d*, and 764*c* can comprise the minimum thickness of the faceplate 714. In some embodiments, the thin sections 764*a*, 764*b*, 764*c*, 764*d*, and 764*c* can comprise a thickness less than approximately 0.070 inch, 0.065 inch, 0.060 inch, 0.055 inch, or 0.050 inch. The thin sections 764*a*, 764*b*, 764*c*, 764*d*, and 764*c* across an entirety of the faceplate lower portion 740 can be less than the minimum thickness of the upper portion 732 thickness, the minimum thickness of the reinforcement region 754, and the minimum thickness of each of the plurality of lower portion ribs 760.

Each of the plurality of lower portion ribs 760 can comprise one or more rib transition regions 762. The rib transition regions 762 can be provided on either side of each rib and can provide a gradual change in thickness between the thickness of the rib and the thickness of the thin sections 764*a*, 764*b*, 764*c*, 764*d*, and 764*c*. The lower portion ribs 760 can comprise a constant thickness or a tapered thickness extending outward from the reinforcement region 754.

Each of the plurality of lower portion ribs 760 can comprise a rib axis 766, that converges at a rib center point 768. In some embodiments, the rib center point 768 is synonymous with the geometric face center 728. In other embodiments, the rib center point 768 is offset by an X axis 1000 and/or a Y axis distance from geometric face center 728 between 0.01 inch and 0.1 inch, 0.01 inch and 0.02 inch, 0.02 inch and 0.03 inch, 0.03 inch and 0.04 inch, 0.04 inch and 0.05 inch, 0.0 inch and 0.06 inch, 0.06 inch and 0.07 inch, 0.07 inch and 0.08 inch, 0.08 inch and 0.09 inch, or 0.09 inch and 0.1 inch.

The plurality of lower portion ribs can further comprise a rib height measured as the distance between a rib rear surface 772 and a rear surface of the thin sections 764*a*, 764*b*, 764*c*, 764*d*, and 764*c*. The rib height can be between 0.004 inch and 0.008 inch, 0.004 inch and 0.0045 inch, 0.0045 inch and 0.005 inch, 0.005 inch and 0.0055 inch, 0.0055 inch and 0.006 inch, 0.006 inch and 0.0065 inch, 0.0065 inch and 0.007 inch, 0.007 inch and 0.0075 inch, or 0.0075 inch and 0.008 inch.

In many embodiments, the faceplate 714 maximum thickness can be between approximately 0.080 inch and 0.120 inch, 0.080 inch and 0.085 inch, 0.085 inch and 0.090 inch, 0.090 inch and 0.095 inch, 0.095 inch and 0.100 inch, 0.100 inch and 0.105 inch, 0.105 inch and 0.110 inch, 0.0110 inch and 0.115 inch, or 0.115 inch and 0.120 inch. In some embodiments, the faceplate upper portion 732 comprises multiple thicknesses including a maximum upper portion thickness 734 and a minimum upper portion thickness 734. In many embodiments, the maximum upper portion thickness 734 can be between approximately 0.080 inch and 0.120 inch, 0.080 inch and 0.085 inch, 0.085 inch and 0.090 inch, 0.090 inch and 0.095 inch, 0.095 inch and 0.100 inch, 0.100 inch and 0.105 inch, 0.105 inch and 0.110 inch, 0.0110 inch and 0.115 inch, or 0.115 inch and 0.120 inch. In many embodiments, the minimum upper portion thickness 734 can be between approximately 0.070 inch and 0.090 inch, 0.070 inch 0.075 inch, 0.075 inch and 0.080 inch, 0.080 inch and 0.085 inch, or 0.085 inch and 0.090 inch.

The faceplate lower portion 740 comprises the minimum thickness of the faceplate 714. In many embodiments, the faceplate 714 minimum thickness can be between approximately 0.050 inch and 0.079 inch, 0.050 inch and 0.055 inch, 0.055 inch and 0.060 inch, 0.060 inch and 0.065 inch, 0.065 inch and 0.070 inch, 0.070 inch and 0.075 inch, or 0.075 inch and 0.079 inch. In some embodiments, the faceplate lower portion 740 comprises multiple thicknesses including a maximum lower portion thickness 742 and a minimum lower portion thickness 742. In many embodiments, the maximum lower portion thickness 742 can be between approximately 0.065 inch and 0.079 inch, 0.065 inch and 0.070 inch, 0.070 inch and 0.075 inch, or 0.075 inch and 0.079. In many embodiments, the minimum lower portion thickness 742 can be between approximately 0.050 inch and 0.075 inch, 0.050 inch and 0.055 inch, 0.055 inch and 0.060 inch, 0.060 inch and 0.065 inch, 0.065 inch and 0.070 inch, or 0.070 inch and 0.075 inch. The faceplate lower portion thickness 742 across an entirety of the faceplate lower portion can be less than the minimum faceplate upper portion thickness 734.

The faceplate examples enumerated above comprise an upper portion thickness that is never less than a lower portion thickness. The lower portion comprising a thickness less than the upper portion thickness provides more flexure to impacts in the lower portion. More flexure in the lower portion increases the ball speed on low mishits.

Example 1—Split Vs Uniform

In a first performance example, internal energies resulting from impacts were compared among a first exemplary club head and a control club head. The first performance test was conducted to simulate impacts at the geometric center of the first exemplary club head and the control club head with a golf ball traveling at 95 MPH. The first exemplary club head comprised a split variable face thickness similar to golf club head 400 described above. The first exemplary club head comprised a uniform upper portion thickness, a reinforcement region located proximate the center of the strike face, in a heel-to-toe direction, and protruded from the faceplate upper portion down into a lower portion (similar to FIG. 10). The faceplate upper portion comprised a 0.08 inch thickness, the reinforcement region comprised a 0.08 inch thickness and the faceplate lower portion comprised a 0.06 inch thickness. The control club head comprised a uniform face thickness of 0.086 inch.

Figure 15:
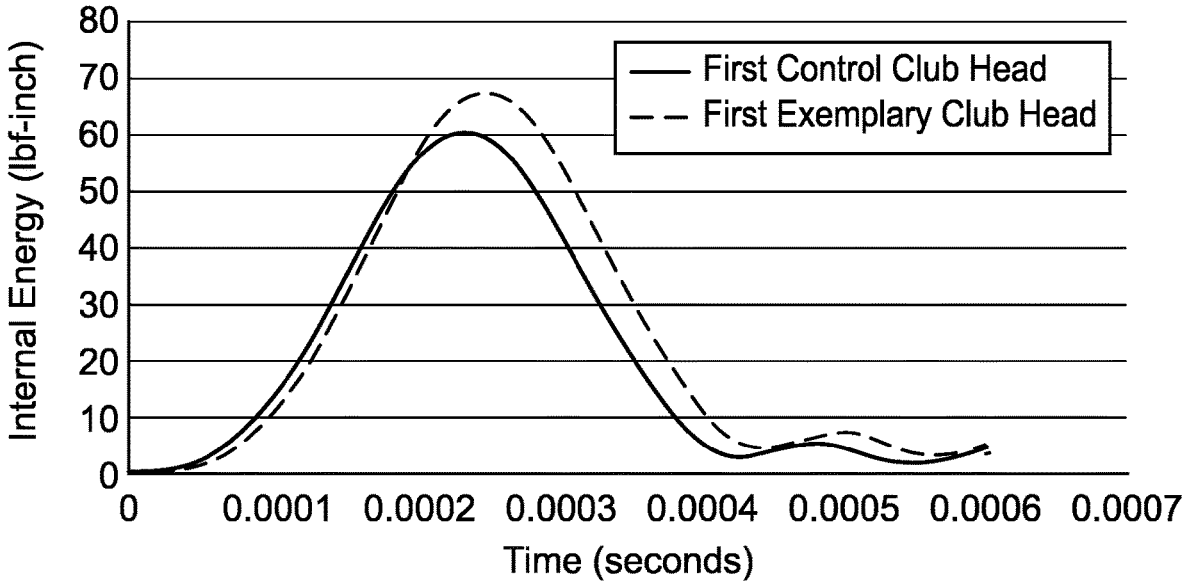
FIG. 15 illustrates a plot of the internal energy vs. time for exemplary and control club heads evaluated in certain examples described herein.

With reference to FIG. 15 and Table 1 below, the first performance test results were as follows: the first exemplary club head had an internal energy of 68.6 lbf-inch; and the control club head had an internal energy of 60.4 lbf-inch. The first performance test proved in simulation that for similar test impacts, the first exemplary club head had increased internal energy relative to the control club head. The first exemplary club head had 8.2 lbf-inch more internal energy than the control club head. This increase in internal energy will yield approximately 0.25 to 4 MPH in additional ball speed.

TABLE 1

| Club Head | Internal Energy [lbf-inch] |
|---|---|
| First Exemplary | 68.6 |
| Control | 60.4 |

Example 2—Ribs Vs Uniform Low Impact

In a second performance example, internal energies resulting from impacts were compared among a second exemplary club head, and the control club head. The second performance test used simulated impacts 0.248 inch below the geometric center of the second exemplary club head and the control club head with a golf ball traveling at 95 MPH. The second exemplary club head comprised a variable face thickness comprising a plurality of ribs within a lower portion and a reinforcement region similar to club head 700 described above. The second exemplary club head comprised a lower portion minimum thickness of 0.066 inch, a maximum lower portion thickness of 0.072 inch, a reinforcement region comprising a thickness of 0.086 inch, and an upper portion constant thickness of 0.086 inch. The plurality of faceplate lower portions ribs extend from the reinforcement region (similar to FIG. 14). The plurality of lower portion ribs comprised a thickness of 0.072 inch. The control club head comprised a uniform face thickness of 0.086 inch.

Figure 16:
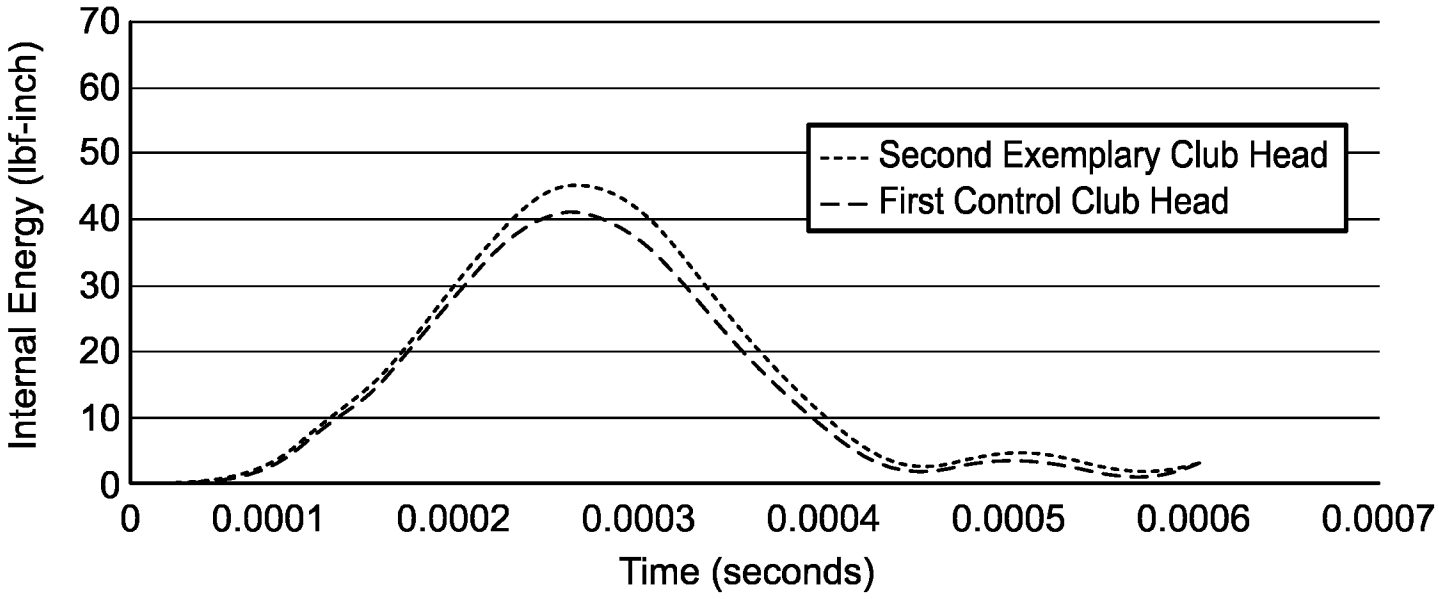
FIG. 16 illustrates a plot of the internal energy vs. time for exemplary and control club heads evaluated in certain examples described herein.

With reference to FIG. 16 and Table 2 below, the second performance test results were as follows: the second exemplary club head had an internal energy of 45.1 lbf-inch; and the control club head had an internal energy of 40.8 lbf-inch. The second performance test proved in simulation that for similar test impacts, the second exemplary club head had increased internal energy relative to the control club head. The second exemplary club head had 4.3 lbf-inch more internal energy than the control club head. This increase in internal energy will yield approximately 0.25 to 4 MPH in additional ball speed on low impacts.

TABLE 2

| Club Head | Internal Energy [lbf-inch] |
|---|---|
| Second Exemplary | 45.1 |
| Control | 40.8 |

Example 3—Ribs Vs Uniform Low Impact

In a third performance example, internal energies resulting from impacts were compared among the second exemplary club head, and the control club head. The third performance test used simulated impacts on the geometric center of the second exemplary club head and the control club head with a golf ball traveling at 95 MPH. The second exemplary club head comprised a variable face thickness comprising a plurality of ribs within a lower portion and a reinforcement region similar to club head 700 described above. The second exemplary club head comprised a lower portion minimum thickness of 0.066 inch, a maximum lower portion thickness of 0.072 inch, a reinforcement region comprising a thickness of 0.086 inch, and an upper portion constant thickness of 0.086 inch. The plurality of faceplate lower portions ribs extend from the reinforcement region (similar to FIG. 14). The plurality of lower portion ribs comprised a thickness of 0.072 inch. The control club head comprised a uniform face thickness of 0.086 inch.

Figure 17:
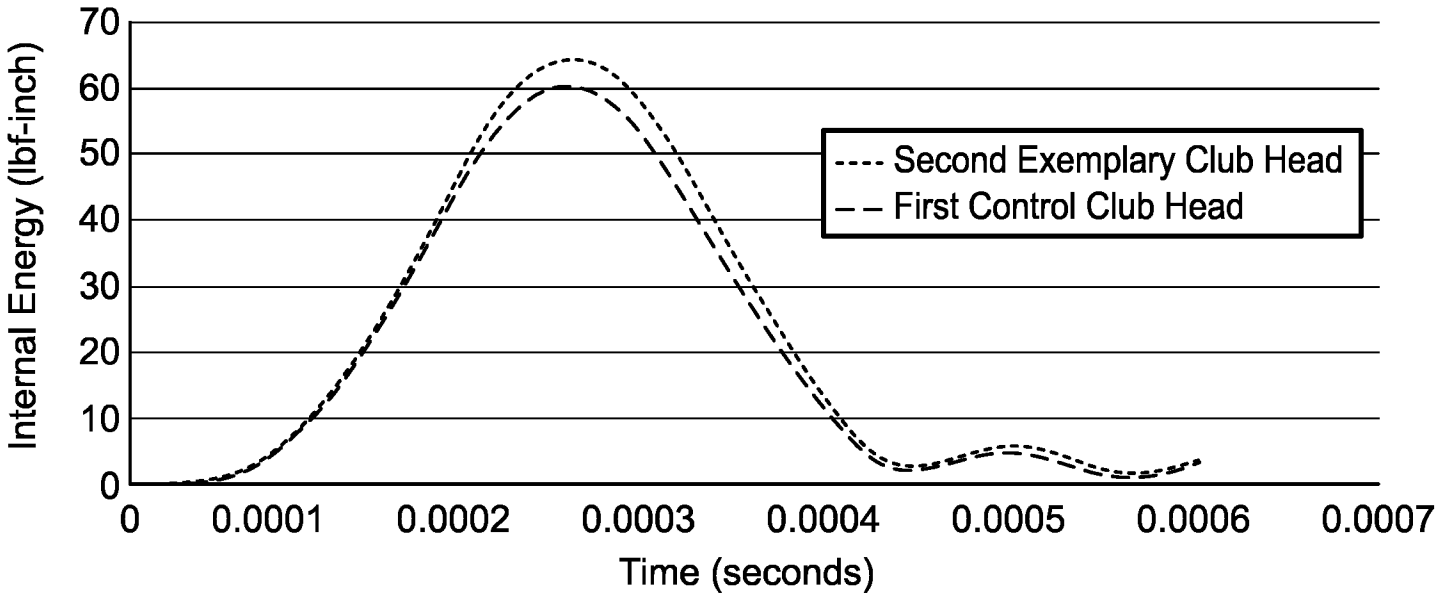
FIG. 17 illustrates a plot of the internal energy vs. time for exemplary and control club heads evaluated in certain examples described herein.

With reference to FIG. 17 and Table 3 below, the third performance test results were as follows: the second exemplary club head had an internal energy of 64.7 lbf-inch; and the control club head had an internal energy of 60.1 lbf-inch. The third performance test proved in simulation that for similar test impacts, the second exemplary club head had increased internal energy relative to the control club head. The second exemplary club head had 4.6 lbf-inch more internal energy than the control club head. This increase in internal energy will yield approximately 0.25 to 4 MPH in additional ball speed.

TABLE 3

| Club Head | Internal Energy [lbf-inch] |
|---|---|
| Second Exemplary | 64.7 |
| Control | 60.1 |

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to $ocm^3ur$ or become more pronounced, however, are not to be construed as critical, required, or essential features or elements of any or all of the claims, unless such benefits, advantages, solutions, or elements are stated in such claim.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

The invention claimed is:

1. A golf club head comprising:

a rear body; and a faceplate coupled to the rear body and comprising at least a majority of a strike face;

wherein the faceplate comprises:

a faceplate front surface;

a faceplate rear surface opposite the faceplate front surface;

a geometric face center;

a horizontal midline extending across the faceplate and parallel to a ground plane;

a faceplate upper portion located above the horizontal midline; and a faceplate lower portion located below the horizontal midline;

wherein the faceplate upper portion has a faceplate upper portion thickness measured from the faceplate front surface to the faceplate rear surface;

wherein the faceplate lower portion has a faceplate lower portion thickness measured from the faceplate front surface to the faceplate rear surface;

wherein the faceplate upper portion thickness comprises a minimum faceplate upper portion thickness;

wherein the faceplate lower portion thickness across an entirety of the faceplate lower portion is less than the minimum faceplate upper portion thickness;

wherein the faceplate upper portion thickness is uniform across an entirety of the faceplate upper portion, and the faceplate lower portion thickness uniformly tapers from the horizontal midline to a sole; and a plurality of lower portion ribs formed in the faceplate lower portion, wherein each of the plurality of lower portion ribs has a rib height measured from the faceplate rear surface to a rib rear surface, and wherein the rib height of each of the plurality of lower portion ribs is less than the minimum faceplate upper portion thickness.

2. The golf club head of claim 1, wherein the faceplate upper portion thickness is between 0.085 inch and 0.120 inch.

3. The golf club head of claim 1, wherein the faceplate lower portion thickness is between 0.070 inch and 0.85 inch.

4. The golf club head of claim 1, wherein the faceplate upper portion thickness is between 0.085 inch and 0.120 inch, and wherein the faceplate lower portion thickness is between 0.070 inch and 0.85 inch.

5. The golf club head of claim 1, wherein each of the plurality of lower portion ribs extends along a rib axis, and wherein each rib axis converges toward a rib center point.

6. The golf club head of claim 1, wherein the plurality of lower portion ribs comprises four lower portion ribs.

7. The golf club head of claim 1, wherein the faceplate lower portion further comprises a reinforcement region bordering the horizontal midline and proximate the geometric face center.

8. The golf club head of claim 7, wherein the reinforcement region comprises a reinforcement region thickness that is equal to the minimum faceplate upper portion thickness.

9. The golf club head of claim 7, wherein the reinforcement region comprises a reinforcement region thickness that is less than the minimum faceplate upper portion thickness.

10. The golf club head of claim 7, wherein the reinforcement region has a semi-ovular shape.

11. The golf club head of claim 1, wherein the horizontal midline is located at a midline height that is 40-60% of a strike face height.

* * * * *